US005673061A

United States Patent [19]

Okada et al.

[11] Patent Number: 5,673,061

[45] Date of Patent: Sep. 30, 1997

[54] DRIVING CIRCUIT FOR DISPLAY APPARATUS

[75] Inventors: Hisao Okada, Nara-ken; Yuji Yamamoto, Kobe; Mitsuyoshi Seo, Tenri; Kuniaki Tanaka, Nara, all of Japan

[73] Assignee: Sharp Kabushiki Kaisha, Osaka, Japan

[21] Appl. No.: 708,784

[22] Filed: Sep. 9, 1996

Related U.S. Application Data

[63] Continuation of Ser. No. 330,385, Oct. 27, 1994, abandoned, which is a continuation-in-part of Ser. No. 234,375, Apr. 28, 1994, abandoned.

[30] Foreign Application Priority Data

May 14, 1993 [JP] Japan ..... 5-113465
Nov. 26, 1993 [JP] Japan ..... 5-297103

[51] Int. Cl.[6] ..... G09G 3/36

[52] U.S. Cl. ..... 345/89; 345/98; 345/147

[58] Field of Search ..... 345/87, 88, 89, 345/90, 91, 92, 93, 94, 95, 98, 99, 100, 101, 147, 148, 149, 208

[56] References Cited

U.S. PATENT DOCUMENTS 5,162,786 11/1992 Fukada .
5,583,531 12/1996 Okada et al. ..... 345/89

FOREIGN PATENT DOCUMENTS

0171547A2 2/1986 European Pat. Off. .
0433054A2 6/1991 European Pat. Off. .
0515191A2 11/1992 European Pat. Off. .
0624862A2 11/1994 European Pat. Off. .
4136983 5/1992 Japan .
4140787 5/1992 Japan .
535202 2/1993 Japan .
5100630 4/1993 Japan .
5100635 4/1993 Japan .
5504213 7/1993 Japan .
5224631 9/1993 Japan .
627900 4/1994 Japan .

OTHER PUBLICATIONS

Article entitled "TFT–LCDs Using Newly Designed 6–bit Digital Data Drivers" by Messrs. Okada, Uehira, Fukuoka, Kanatani, and Hijikigawa from Sharp Corp., Nara, Japan; 1993 SID International Symposium, pp. 11–14 of the SID 93 DIGEST.

*Primary Examiner*—Regina D. Liang

[57] ABSTRACT

A driving circuit of the invention is used for driving a display apparatus which includes pixels and data lines for applying voltages to the pixels and which displays an image with multiple gray scales in accordance with video data consisting of a plurality of bits. The driving circuit includes: an oscillating signal specifying section for specifying one of a plurality of oscillating signals having respective mean values which are different from each other in accordance with video data consisting of bits selected from the plurality of bits, and for outputting the specified oscillating signal T and an oscillating signal T-bar which is obtained by inverting the specified oscillating signal T; a gray-scale voltage specifying section for producing gray-scale voltage specifying signals which specify a first gray-scale voltage and a second gray-scale voltage among a plurality of gray-scale voltages supplied from a gray-scale voltage supply section, in accordance with video data consisting of bits other than the selected bits of the plurality of bits; and an output section for outputting the first gray-scale voltage and the second gray-scale voltage specified by the gray-scale voltage specifying signals to the data lines, in accordance with the oscillating signal T and the oscillating signal T-bar.

16 Claims, 25 Drawing Sheets

70

90

95

S94206

160

180

200

DRIVING CIRCUIT FOR DISPLAY APPARATUS

CROSS-REFERENCE TO RELATED APPLICATION

This application is a continuation of application Ser. No. 08/330,385 filed on Oct. 27, 1994, now abandoned, which application is a continuation-in-part of co-pending U. S. patent application Ser. No. 08/234,375, filed Apr. 28, 1994 now abandoned.

BACKGROUND OF THE INVENTION

1. Field of the Invention

The present invention relates to a driving circuit for a display apparatus. More particularly, the present invention relates to a driving circuit for an active matrix type liquid crystal display apparatus which displays an image with multiple gray scales in accordance with digital video signals.

2. Description of the Related Art

An active matrix type liquid crystal display apparatus includes a display panel and a driving circuit for driving the display panel. The display panel includes a pair of glass substrates and a liquid crystal layer formed between the pair of glass substrates. On one of the pair of glass substrates, a plurality of gate lines and a plurality of data lines are formed. The driving circuit is disposed for every data line in the display panel, and the driving circuit applies a driving voltage to the liquid crystal layer of the display panel. The driving circuit includes a gate driver for selecting a plurality of switching elements connected to the gate lines and the data lines for every gate line, and a data driver for supplying a video signal corresponding to an image to pixel electrodes via the selected switching elements.

FIG. 21 shows a configuration for a part of a data driver in a prior art driving circuit. The circuit 210 shown in FIG. 21 outputs a video signal to one of a plurality of data lines. Accordingly, the data driver requires circuits 210 the number of which is equal to the number of data lines provided in a display panel. For simplicity of explanation, it is herein assumed that video data consists of three bits ($D_0$, $D_1$, $D_2$). On such an assumption, the video data may have eight values of 0 to 7, and a signal voltage supplied to each pixel is one of eight levels $V_0$–$V_7$.

The circuit 210 includes a sampling flip-flop $M_{SMP}$, a holding flip-flop $M_H$, a decoder DEC, and analog switches $ASW_0$–$ASW_7$. To each of the analog switches $ASW_0$–$ASW_7$, a corresponding one of external source voltages $V_0$–$V_7$ of the respective eight levels which are different from each other is supplied. In addition, to the analog switches $ASW_0$–$ASW_7$, control signals $S_0$–$S_7$ are supplied from the decoder DEC, respectively. Each of the control signals $S_0$–$S_7$ is used for switching the ON/OFF state of the analog switch.

Next, the operation of the circuit 210 is described. At the rising of a sampling pulse $T_{SMPn}$ corresponding to the nth pixel, the sampling flip-flop $M_{SMP}$ gets video data ($D_0$, $D_1$, $D_2$), and holds the video data therein. When such video data sampling for one horizontal period is completed, an output pulse signal OE is applied to the holding flip-flop $M_H$. Upon receiving the output pulse signal OE, the holding flip-flop $M_H$ gets the video data ($D_0$, $D_1$, $D_2$) from the sampling flip-flop $M_{SMP}$, and transfers the video data to the decoder DEC.

The decoder DEC decodes the video data ($D_0$, $D_1$, $D_2$), and produces a control signal for turning on one of the analog switches $ASW_0$–$ASW_7$ in accordance with the respective values (0–7) of the video data ($D_0$, $D_1$, $D_2$). As a result, one of the external source voltages $V_0$–$V_7$ is output to a data line $O_n$. For example, in the case where the value of the video data held in the holding flip-flop $M_H$ is 3, the decoder DEC outputs a control signal $S_3$ which turns on the analog switch $ASW_3$. As a result, the analog switch $ASW_3$ becomes into the ON-state, and $V_3$ of the external source voltages $V_0$–$V_7$ is output to the data line $O_n$.

Such a prior art data driver involves a problem in that, as the number of bits in video data increases, the circuit configuration becomes complicated and the size of the circuit is increased. This is because the prior art data driver requires gray-scale voltages the number of which is equal to the gray scales to be displayed. For example, in the case where the video data consists of 4 bits for displaying 16 gray-scale images, the number of required gray-scale voltages is: $2^4=16$. Similarly, in the case where the video data consists of 6 bits for displaying 64 gray-scale images, the number of required gray-scale voltages is: $2^6=64$. In the case of 8-bit video data for displaying 256 gray-scale images, the number of required gray-scale voltages is: $2^8=256$. As described above, the prior art data driver requires a large number of gray-scale voltages as the number of bits of video data increases. This causes the circuit configuration to be complicated and the circuit size to be increased. Moreover, interconnections between voltage source circuits and analog switches are also complicated.

For the above-mentioned reasons, the actual application of such a prior art data driver is limited to 3-bit video data or 4-bit video data.

In order to solve such prior art problems, there have been proposed methods and circuits for driving a display apparatus in Japanese Laid-Open Patent Publication Nos. 4-136983, 4-140787, and 6-27900.

FIG. 22 shows a configuration for a part of a driving circuit disclosed in Japanese Laid-Open Patent Publication No. 6-27900. The circuit 220 shown in FIG. 22 outputs a video signal to one of a plurality of data lines. Accordingly, the data driver requires circuits 220 the number of which is equal to the number of data lines provided in a display panel. It is herein assumed that video data consists of 6 bits ($D_0$, $D_1$, $D_2$, $D_3$, $D_4$, $D_5$). On such an assumption, the video data may have 64 values of 0–63, and a signal voltage applied to each pixel is one of nine gray-scale voltages $V_0$, $V_8$, $V_{16}$, $V_{24}$, $V_{32}$, $V_{40}$, $V_{48}$, $V_{56}$, and $V_{64}$, and a plurality of interpolated voltages which are produced from the gray-scale voltages $V_0$, $V_8$, $V_{16}$, $V_{24}$, $V_{32}$, $V_{40}$, $V_{48}$, $V_{56}$, and $V_{64}$.

The circuit 220 includes a sampling flip-flop $M_{SMP}$, a holding flip-flop $M_H$, a selection control circuit SCOL, and analog switches $ASW_0$–$ASW_8$. To each of the analog switches $ASW_0$–$ASW_8$, a corresponding one of gray-scale voltages $V_0$, $V_8$, $V_{16}$, $V_{24}$, $V_{32}$, $V_{40}$, $V_{48}$, $V_{56}$, and $V_{64}$ of respective levels which are different from each other is supplied. To the analog switches $ASW_0$–$ASW_8$, control signals $S_0$, $S_8$, $S_{16}$, $S_{24}$, $S_{32}$, $S_{40}$, $S_{48}$, $S_{56}$, and $S_{64}$ are supplied from the selection control circuit SCOL, respectively. Each of the control signals are used to switch the ON/OFF state of the analog signal.

To the selection control circuit SCOL, clock signals $t_1$, $t_2$, $t_3$, and $t_4$ are supplied. As is shown in FIG. 23, the clock signals $t_1$, $t_2$, $t_3$, and $t_4$ have duty ratios which are different from each other. The selection control circuit SCOL receives 6-bit video data $d_5$, $d_4$, $d_3$, $d_2$, $d_1$, and $d_0$, and outputs one of control signals $S_0$, $S_8$, $S_{16}$, $S_{24}$, $S_{32}$, $S_{40}$, $S_{48}$, $S_{56}$, and $S_{64}$ in accordance with the value of the received video data. The relationship between the input and the output of the selection control circuit SCOL is determined by using a logical table.

Table 1 shows a logical table for the selection control circuit SCOL. The 1st to 6th columns of Table 1 indicate values of bits $d_5$, $d_4$, $d_3$, $d_2$, $d_1$, and $d_0$ of the video data, respectively. The 7th to 15th columns of Table 1 indicate values of control signals $S_0$, $S_8$, $S_{16}$, $S_{24}$, $S_{32}$, $S_{40}$, $S_{48}$, $S_{56}$, and $S_{64}$, respectively. Each blank in the 7th to 15th columns in Table 1 means that the value of the control signal is 0. In addition, "$t_i$" indicates that the value of the control signal is 1 when the value of the clock signal $t_i$ is 1, and the value of the control signal is 0 when the value of the clock signal $t_i$ is 0. Also, "$t_i$-bar" indicates that the value of the control signal is 0 when the value of the clock signal $t_i$ is 1, and the value of the control signal is 1 when the value of the clock signal $t_i$ is 0. Herein, i=1, 2, 3, and 4. Hereinafter, in this specification, it is defined that the notation 'X-bar' is equivalent to the notation in which 'X' is provided with an upper horizontal bar. Note that 'X' is an arbitrarily selected symbol.

TABLE 1

| $d_5$ | $d_4$ | $d_3$ | $d_2$ | $d_1$ | $d_0$ | $S_0$ | $S_8$ | $S_{16}$ | $S_{24}$ | $S_{32}$ | $S_{40}$ | $S_{48}$ | $S_{56}$ | $S_{64}$ |
|---|---|---|---|---|---|---|---|---|---|---|---|---|---|---|
| 0 | 0 | 0 | 0 | 0 | 0 | 1 | 0 | | | | | | | |
| 0 | 0 | 0 | 0 | 0 | 1 | $t_1$ | $\overline{t_1}$ | | | | | | | |
| 0 | 0 | 0 | 0 | 1 | 0 | $t_2$ | $\overline{t_2}$ | | | | | | | |
| 0 | 0 | 0 | 0 | 1 | 1 | $t_3$ | $\overline{t_3}$ | | | | | | | |
| 0 | 0 | 0 | 1 | 0 | 0 | $t_4$ | $\overline{t_4}$ | | | | | | | |
| 0 | 0 | 0 | 1 | 0 | 1 | $\overline{t_3}$ | $t_3$ | | | | | | | |
| 0 | 0 | 0 | 1 | 1 | 0 | $\overline{t_2}$ | $t_2$ | | | | | | | |
| 0 | 0 | 0 | 1 | 1 | 1 | $\overline{t_1}$ | $t_1$ | | | | | | | |
| 0 | 0 | 1 | 0 | 0 | 0 | 0 | 1 | 0 | 0 | 0 | 0 | 0 | 0 | 0 |
| 0 | 1 | 1 | 1 | 1 | 0 | | | $\overline{t_3}$ | $t_3$ | | | | | |
| 0 | 1 | 1 | 1 | 1 | 1 | | | $\overline{t_2}$ | $t_2$ | | | | | |
| | | | | | | | | $\overline{t_1}$ | $t_1$ | | | | | |
| 1 | 0 | 0 | 0 | 0 | 0 | | | | 1 | 0 | | | | |
| 1 | 0 | 0 | 0 | 0 | 1 | | | | $t_1$ | $\overline{t_1}$ | | | | |
| 1 | 0 | 0 | 0 | 1 | 0 | | | | $t_2$ | $\overline{t_2}$ | | | | |
| 1 | 0 | 0 | 0 | 1 | 1 | | | | $t_3$ | $\overline{t_3}$ | | | | |
| 1 | 0 | 0 | 1 | 0 | 0 | | | | $t_4$ | $\overline{t_4}$ | | | | |
| 1 | 0 | 0 | 1 | 0 | 1 | | | | $\overline{t_3}$ | $t_3$ | | | | |
| 1 | 0 | 0 | 1 | 1 | 0 | | | | $\overline{t_2}$ | $t_2$ | | | | |
| 1 | 0 | 0 | 1 | 1 | 1 | | | | $\overline{t_1}$ | $t_1$ | | | | |
| 1 | 0 | 1 | 0 | 0 | 0 | 0 | 0 | 0 | 0 | | 1 | 0 | 0 | 0 |
| 1 | 1 | 0 | | | | | | | | | | $\overline{t_3}$ | $t_3$ | |
| 1 | 1 | 0 | | | | | | | | | | $\overline{t_2}$ | $t_2$ | 0 |
| 1 | 1 | 0 | 0 | 0 | 0 | | | | | | | $\overline{t_1}$ | $t_1$ | 0 |
| 1 | 1 | 1 | 0 | 0 | 0 | | | | | | | | 1 | 0 |
| 1 | 1 | 1 | 0 | 0 | 1 | | | | | | | | $t_1$ | $\overline{t_1}$ |
| 1 | 1 | 1 | 0 | 1 | 0 | | | | | | | | $t_2$ | $\overline{t_2}$ |
| 1 | 1 | 1 | 0 | 1 | 1 | | | | | | | | $t_3$ | $\overline{t_3}$ |
| 1 | 1 | 1 | 1 | 0 | 0 | | | | | | | | $t_4$ | $\overline{t_4}$ |
| 1 | 1 | 1 | 1 | 0 | 1 | | | | | | | | $\overline{t_3}$ | $t_3$ |
| 1 | 1 | 1 | 1 | 1 | 0 | | | | | | | | $\overline{t_2}$ | $t_2$ |
| 1 | 1 | 1 | 1 | 1 | 1 | | | | | | | | $\overline{t_1}$ | $t_1$ |

As is seen from Table 1, when the value of the video data is a multiple of 8, one of the gray-scale voltages $V_0, \ldots, V_{64}$ is output to the data line $O_n$. When the value of the video data is not a multiple of 8, an oscillating voltage which oscillates between a pair of gray-scale voltages $V_0, \ldots, V_{64}$ at a duty ratio of one of the clock signals $t_1$, $t_2$, $t_3$, and $t_4$ is output to the data line $O_n$. The data driver produces seven different oscillating voltages between respective adjacent gray-scale voltages, in accordance with the logical table of Table 1. Thus, it is possible to attain 64 gray-scale images by using only 9 levels of gray-scale voltages.

The following equations are logical equations which define the relationships among the video data $d_5$, $d_4$, $d_3$, $d_2$, $d_1$, and $d_0$, the clock signals $t_1$, $t_2$, $t_3$, and $t_4$, and the control signals $S_0$, $S_8$, $S_{16}$, $S_{24}$, $S_{32}$, $S_{40}$, $S_{48}$, $S_{56}$, and $S_{64}$ shown in Table 1.

$$S_0=\{0\}+\{1\}t_1+\{2\}t_2 +\{3\}t_3+\{4\}t_4 +\{5\}\text{“}t_3\text{”}+\{6\}\text{“}t_2\text{”} +\{7\}\text{“}t_1\text{”}+\text{tm} \quad (1)$$

$$S_8=\{1\}\text{“}t_1\text{”}+\{2\}\text{“}t_2\text{”}+\{3\}\text{“}t_3\text{”}+\{4\}\text{“}t_4\text{”} +\{5\}t_3+\{6\}t_2+\{7\}t_1 +\{8\}+\{9\}t_1+\{10\}t_2 +\{11\}t_3+\{12\}t_4+\{13\}\text{“}t_3\text{”} +\{14\}\text{“}t_2\text{”}+\{15\}\text{“}t_1\text{”}+\text{tm} \quad (2)$$

$$S_{16}=\{9\}\text{“}t_1\text{”}+\{10\}\text{“}t_2\text{”} +\{11\}\text{“}t_3\text{”}+\{12\}\text{“}t_4\text{”}+\{13\}t_3 +\{14\}t_2+\{15\}t_1+\{16\}+\{17\}t_1 +\{18\}t_2+\{19\}t_3+\{20\}t_4 +\{21\}\text{“}t_3\text{”}+\{22\}\text{“}t_2\text{”}+\{23\}\text{“}t_1\text{”}+\text{tm} \quad (3)$$

Similarly, the control signals $S_{24}$, $S_{32}$, $S_{40}$, and $S_{48}$ are defined. The control signals $S_{56}$ and $S_{64}$ are defined as follows.

$$S_{56} = \{49\}\text{“}t_1\text{”}+\{50\}\text{“}t_2\text{”}+\{51\}\text{“}t_3\text{”}+\{52\}\text{“}t_4\text{”}+ \{53\}t_3+\{54\}t_2+\{55\}t_1+\{56\}+\{57\}t_1+ \{58\}t_2+\{59\}t_3+\{60\}t_4+\{61\}\text{“}t_3\text{”}+\{62\}\text{“}t_2\text{”}+ \{63\}\text{“}t_1\text{”} \quad (4)$$

$$S_{64} = \{57\}\text{“}t_1\text{”}+\{58\}\text{“}t_2\text{”}+\{59\}\text{“}t_3\text{”}+\{60\}\text{“}t_4\text{”}+ \{61\}t_3+\{62\}t_2+\{63\}t_1 \quad (5)$$

In the above equations, {i} indicates a value when the binary data ($d_5$, $d_4$, $d_3$, $d_2$, $d_1$, $d_0$) is represented in the decimal notation. For example, {1}=($d_5$, $d_4$, $d_3$, $d_2$, $d_1$, $d_0$)=(0, 0, 0, 0, 0, 1). In addition, "ti" indicates a signal which is inverted from the signal $t_i$.

On the basis of the above logical equations, logical circuits shown in FIGS. 24 and 25 are obtained. The selection control circuit SCOL is constructed by the logical circuits shown in FIGS. 24 and 25.

The logical circuit shown in FIG. 24 produces 64 kinds of gray-scale selection data {0}–{63} in accordance with the value of 6-bit video data ($d_5$, $d_4$, $d_3$, $d_2$, $d_1$, $d_0$). The logical circuit shown in FIG. 25 produces control signals $S_0$, $S_8$, $S_{16}$, $S_{24}$, $S_{32}$, $S_{40}$, $S_{48}$, $S_{56}$, and $S_{64}$, based on the gray-scale selection data {0}–{63} and the clock signals $t_1$, $t_2$, $t_3$, and $t_4$. For example, a case where the video data ($d_5$, $d_4$, $d_3$, $d_2$, $d_1$, $d_0$)=(0, 0, 0, 0, 0, 1) is input to the selection control circuit SCOL is explained. In such a case, the logical circuit shown in FIG. 24 outputs the gray-scale selection data {1}. The logical circuit shown in FIG. 25 receives the gray-scale selection data {1} and alternately outputs the control signal $S_0$ and the control signal $S_8$ at a duty ratio of the clock signal $t_1$. As a result, the gray-scale voltage $V_0$ and the gray-scale voltage $V_8$ are alternately output via the analog switch $ASW_0$ and the analog switch $ASW_1$ at the duty ratio of the clock signal $t_1$ to the data line $O_n$.

The actual data driver requires the selection control circuits SCOL the number of which is equal to the number of data lines. Thus, the circuit scale of the selection control circuit SCOL largely affects the chip size of the integrated circuit (LSI) on which the data driver is installed. If the circuit scale of the selection control circuit SCOL, becomes large, the cost for the integrated circuit is increased. Moreover, if the number of bits of video data increases in order to realize an image of high resolution, the circuit scale of the data driver is further increased. This also increases the size and the production cost of the integrated circuit.

SUMMARY OF THE INVENTION

The driving circuit of the invention is used for driving a display apparatus which includes pixels and data lines for applying voltages to the pixels and which displays an image with multiple gray scales in accordance with video data consisting of a plurality of bits. The driving circuit includes: oscillating signal specifying means for specifying one of a plurality of oscillating signals having respective mean values which are different from each other in accordance with a value represented by bits selected from the plurality of bits of the video data, and for outputting the specified oscillating signal T and an oscillating signal T-bar which is obtained by inverting the specified oscillating signal T; gray-scale voltage specifying means for producing gray-scale voltage specifying signals which specify a first gray-scale voltage and a second gray-scale voltage among a plurality of gray-scale voltages supplied from gray-scale voltage supply means, in accordance with a value represented by bits other than the selected bits of the plurality of bits of the video data; and output means for outputting the first gray-scale voltage and the second gray-scale voltage specified by the gray-scale voltage specifying signals to the data lines, in accordance with the oscillating signal T and the oscillating signal T-bar.

In one embodiment of the invention, the first gray-scale voltage and the second gray-scale voltage are adjacent ones of the plurality of gray-scale voltages.

In another embodiment of the invention, the plurality of oscillating signals have respective duty ratios which are different from each other. At least one of the plurality of oscillating signals may be an inverted signal which is obtained by inverting another one of the plurality of oscillating signals. The plurality of oscillating signals may include oscillating signals having duty ratios of 8:0, 7:1, 6:2, 5:3, 4:4, 3:5, 2:6, and 1:7, respectively.

In another embodiment of the invention, the video data consists of (x+y) bits, where each of x and y is a positive integer, the gray-scale voltage specifying means produces $(2^x+1)$ kinds of gray-scale voltage specifying signals for specifying $2^x$ pairs of a first gray-scale voltage and a second gray-scale voltage among the plurality of gray-scale voltages, the oscillating signal specifying means outputs $2^y$ pairs of an oscillating signal T and an oscillating signal T-bar, whereby $(2^y-1)$ intermediate voltages of levels different from each other are generated between the first gray-scale voltage and the second gray-scale voltage specified by the gray-scale voltage specifying means, thereby displaying an image with $2^{(x+y)}$ gray scales.

In another embodiment of the invention, the oscillating signal specifying means includes: oscillating signal generating means for receiving a plurality of original oscillating signals and for generating the oscillating signal T by combining the plurality of original oscillating signals; and inversion means for producing the oscillating signal T-bar by inverting the oscillating signal T, and wherein each of the plurality of original oscillating signals has one of a first level value and a second level value, respective periods in which the plurality of original oscillating signals have the first level value in one cycle being different from each other, respective lengths of the periods in which the plurality of original oscillating signals have the first level value in one cycle being weighted in accordance with corresponding bits of the plurality of bits of the video data. The number of the plurality of original oscillating signals may be equal to the number of the selected bits among the plurality of bits of the video data.

According to the invention, a driving circuit for driving a display apparatus which includes pixels and data lines for applying voltages to the pixels and which displays an image with multiple gray scales in accordance with video data consisting of a plurality of bits is provided. The driving circuit includes: control signal generating means for generating a plurality of control signals in accordance with video data consisting of a plurality of bits; and a plurality of switching means, each of the plurality of switching means being supplied with a corresponding one of the plurality of control signals and a corresponding one of a plurality of gray-scale voltage generated by gray-scale voltage generating means, the gray-scale voltage supplied to the switching means being output to the data lines via the switching means in accordance with the control signal supplied to the switching means, wherein the control signal generating means includes: oscillating signal specifying means for specifying one of a plurality of oscillating signals having respective duty ratios which are different from each other in accordance with a value represented by bits selected from the plurality of bits of the video data, and for outputting the specified oscillating signal T and an oscillating signal T-bar which is obtained by inverting the specified oscillating signal T; gray-scale voltage specifying means for producing gray-scale voltage specifying signals which specify a first gray-scale voltage and a second gray-scale voltage among a plurality of gray-scale voltages supplied from gray-scale voltage supply means, in accordance with a value represented by bits other than the selected bits of the plurality of bits of the video data; and output means for outputting a first control signal which oscillates at a duty ratio substantially equal to that of the oscillating signal T to the switching means which are supplied with the first gray-scale voltage specified by the gray-scale voltage specifying signals and for outputting a second control signal which oscillates at a duty ratio substantially equal to that of the oscillating signal T-bar to the switching means which are supplied with the second gray-scale voltage specified by the gray-scale voltage specifying signals.

In one embodiment of the invention, the first gray-scale voltage and the second gray-scale voltage are adjacent ones of the plurality of gray-scale voltages.

In another embodiment of the invention, at least one of the plurality of oscillating signals is an inverted signal which is obtained by inverting another one of the plurality of oscillating signals.

In another embodiment of the invention, the plurality of oscillating signals include oscillating signals having duty ratios of 8:0, 7:1, 6:2, 5:3, 4:4, 3:5, 2:6, and 1:7, respectively.

In another embodiment of the invention, the video data consists of (x+y) bits, where each of x and y is a positive integer, the gray-scale voltage specifying means produces $(2^x+1)$ kinds of gray-scale voltage specifying signals for specifying $2^x$ pairs of a first gray-scale voltage and a second gray-scale voltage among the plurality of gray-scale voltages, the oscillating signal specifying means outputs $2^y$ pairs of an oscillating signal T and an oscillating signal T-bar, whereby $(2^y-1)$ intermediate voltages of levels different from each other are generated between the first gray-scale voltage and the second gray-scale voltage specified by the gray-scale voltage specifying means, thereby displaying an image with $2^{(x+y)}$ gray scales.

In another embodiment of the invention, the oscillating signal specifying means includes: oscillating signal generating means for receiving a plurality of original oscillating signals and for generating the oscillating signal T by combining the plurality of original oscillating signals; and inversion means for producing the oscillating signal T-bar by inverting the oscillating signal T, and wherein each of the plurality of original oscillating signals has one of a first level value and a second level value, respective periods in which the plurality of original oscillating signals have the first level value in one cycle being different from each other, respective lengths of the periods in which the plurality of original oscillating signals have the first level value in one cycle being weighted in accordance with corresponding bits of the plurality of bits of the video data.

In another embodiment of the invention, the number of original oscillating signals is equal to the number of the selected bits of the plurality of bits of the video data.

In another embodiment of the invention, the switching means is an analog switch.

A display apparatus displays an image with multiple gray scales in accordance with video data consisting of a plurality of bits. The display apparatus includes a display section having a plurality of pixels arranged in a matrix and a plurality of data lines for applying voltages to the plurality of pixels, and a driving circuit for driving the display section.

The driving circuit according to the invention includes oscillating signal specifying means, gray-scale voltage specifying means, and output means. The oscillating signal specifying means specifies one of a plurality of oscillating signals having mean values different from each other, in accordance with a value represented by bits selected from a plurality of bits of the video data. The gray-scale voltage specifying means specifies a pair of gray-scale voltages from a plurality of gray-scale voltages, in accordance with a value represented by the remaining bits other than the above-selected bits. The output means outputs oscillating voltages which oscillate between the pair of gray-scale voltages to data lines, based on the specified oscillating signal and the specified pair of gray-scale voltages. Accordingly, it is possible to realize a plurality of interpolated gray scales between the gray scales corresponding to the plurality of given gray-scale voltages.

The plurality of oscillating signals may alternatively be generated by combining a predetermined number of oscillating signals. By reducing the number of oscillating signals, the scale of the driving circuit can be reduced.

According to the driving circuit of the invention, by using the gray-scale voltage specifying means and the oscillating signal specifying means, it is possible to design a logical circuit in the same manner in both cases where the driving circuit directly outputs one of the plurality of gray-scale voltages and where the driving circuit alternately outputs the specified pair of gray-scale voltages.

Accordingly, it is unnecessary to provide an additional driving circuit depending on the cases where the driving circuit directly outputs one of the plurality of gray-scale voltages and where the driving circuit alternately outputs the specified pair of gray-scale voltages. As a result, it is possible to simplify the configuration of the driving circuit, and the size of the driving circuit can be minimized.

Thus, the invention described herein makes possible the advantage of providing a driving circuit for a display apparatus, which has a simplified and small construction, and which can display an image with multiple gray scales in accordance with multi-bit video data.

This and other advantages of the present invention will become apparent to those skilled in the art upon reading and understanding the following detailed description with reference to the accompanying figures.

DESCRIPTION OF THE PREFERRED EMBODIMENTS

Hereinafter, the present invention will be described by way of illustrative examples in accordance with the accompanying drawings. In the following description, a matrix type liquid crystal display apparatus is used as an example of a display apparatus. It is appreciated that the present invention is also applicable to other types of display apparatus.

EXAMPLE 1

Figure 1:
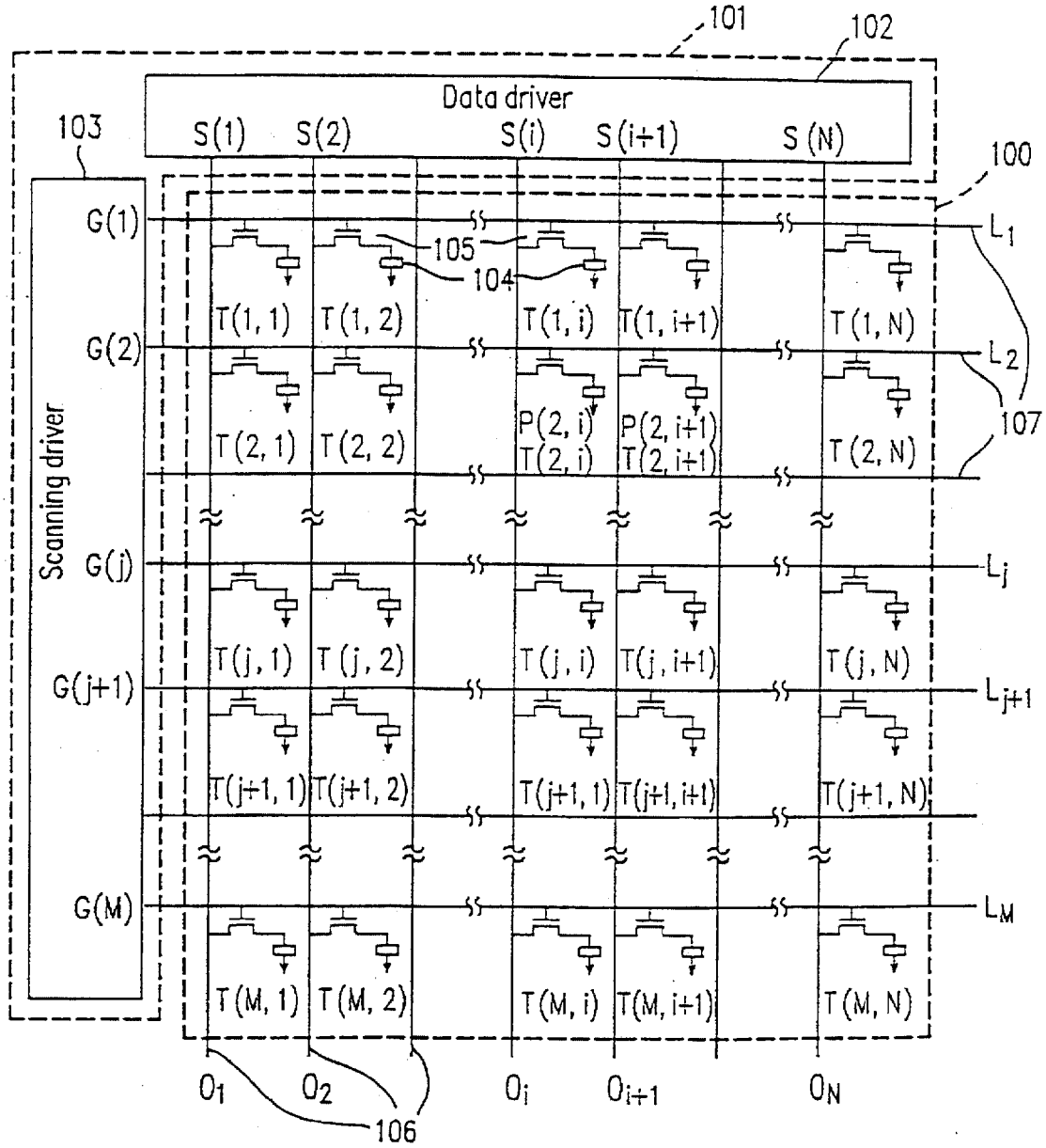
FIG. 1 is a diagram showing the construction of a liquid crystal display apparatus.

FIG. 1 shows a construction of a matrix type liquid crystal display apparatus. The liquid crystal display apparatus shown in FIG. 1 includes a display section 100 for displaying a video image, and a driving circuit 101 for driving the display section 100. The driving circuit 101 includes a data driver 102 which provides video signals to the display section 100 and a scanning driver 103 which provides scanning signals to the display section 100. The data driver may be called "a source driver" or "a column driver". The scanning driver may be called "a gate driver" or "a row driver".

The display section 100 includes an M×N array of pixels 104 (M pixels in each column and N pixels in each row; where M and N are positive integers), and also includes switching elements 105 respectively connected to the pixels 104.

In FIG. 1, N data lines 106 are used for connecting respective output terminals S(i) (i=1, 2, . . . , N) of the data driver 102 to the corresponding switching elements 105. Similarly, M scanning lines 107 are used for connecting respective output terminals G(j) (j=1, 2, . . . , M) of the scanning driver 103 to the corresponding switching elements 105. As the switching elements 105, thin film transistors (TFTs) can be used. Alternatively, other types of switching elements may also be used. The data line may be called "a source line" or "a column line". The scanning line may be called "a gate line" or "a row line".

The scanning driver 103 sequentially outputs a voltage which is kept at a high level during a specific time period from its output terminals G(j) to the corresponding scanning lines 107. The specific time period is referred to as one horizontal period jH (where j is an integer of 1 to M). The total length of time obtained by adding up all the horizontal periods jH (i.e., 1H+2H+3H+ . . . +MH), a blanking period and a vertical synchronizing period is referred to as one vertical period.

When the level of the voltage which is output from the output terminal G(j) of the scanning driver 103 to the scanning line 107 is high, the switching element 105 connected to the output terminal G(j) is in the ON-state. When the switching element 105 is in the ON-state, the pixel 104 connected to the switching element 105 is charged in accordance with the voltage which is output from the output terminal S(i) of the data driver 102 to the corresponding data line 106. The voltage of the thus charged pixel 104 remains unchanged for about one vertical period until it is charged again by the subsequent voltage to be supplied from the data driver 102.

Figure 2:
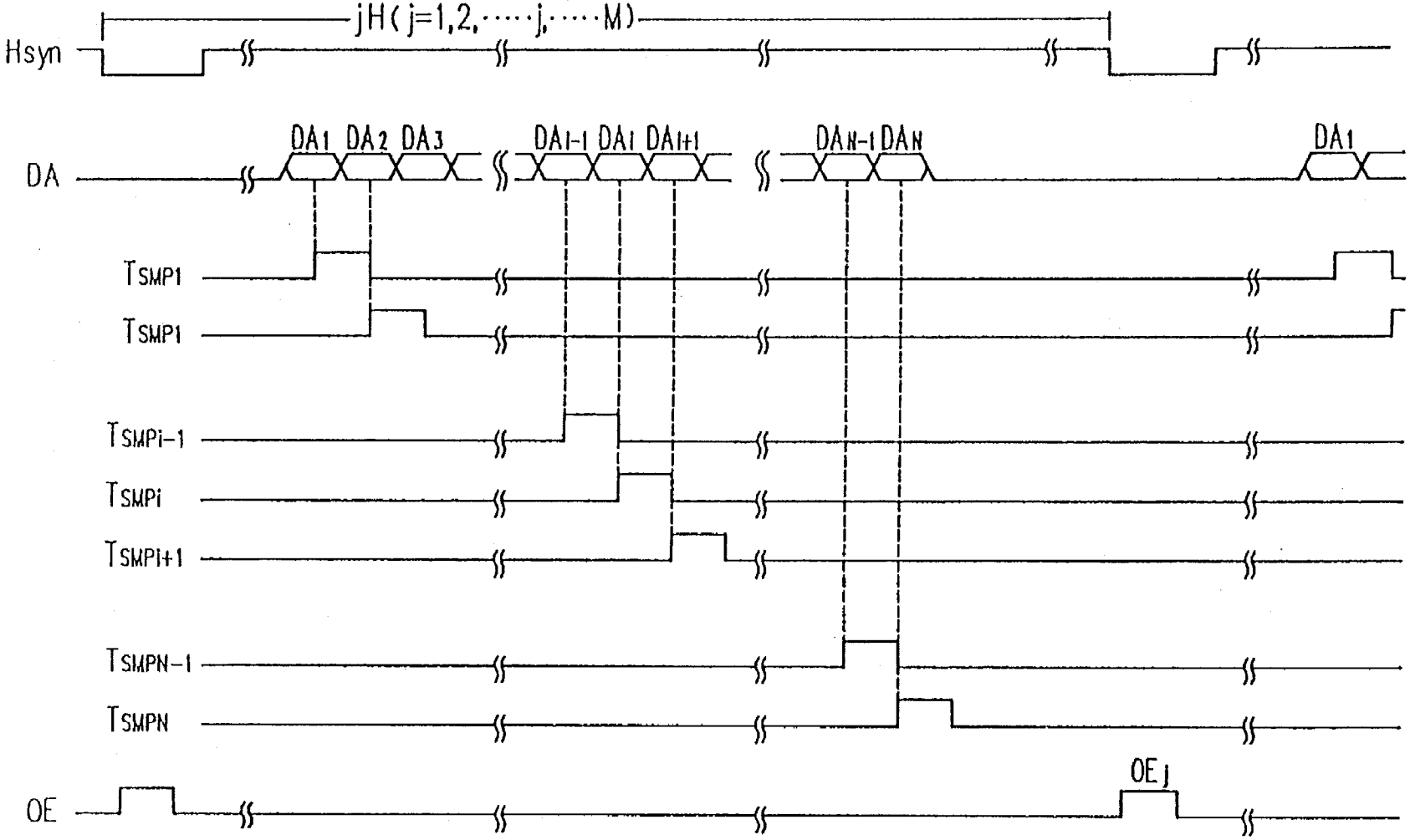
FIG. 2 is a timing diagram illustrating the relationship among input data, sampling pulses, and an output pulse in one horizontal period.

FIG. 2 shows the relationship among digital video data DA, sampling pulses $T_{smpi}$, and an output pulse signal OE, during the jth horizontal period jH determined by a horizontal synchronizing signal $H_{syn}$. As can be seen from FIG. 2, while sampling pulses $T_{smp1}$, $T_{smp2}$, . . . , $T_{smpi}$, . . . , and $T_{smpN}$ are sequentially applied to the data driver 102, digital video data $DA_1$, $DA_2$ . . . , $DA_i$ . . . , and $DA_N$ are fed into the data driver 102 accordingly. The jth output pulse $OE_j$ determined by the output pulse signal OE is then applied to the data driver 102. On receiving the jth output pulse $OE_j$, the data driver 102 outputs voltages from its output terminals S(i) to the corresponding data lines 106.

Figure 3:
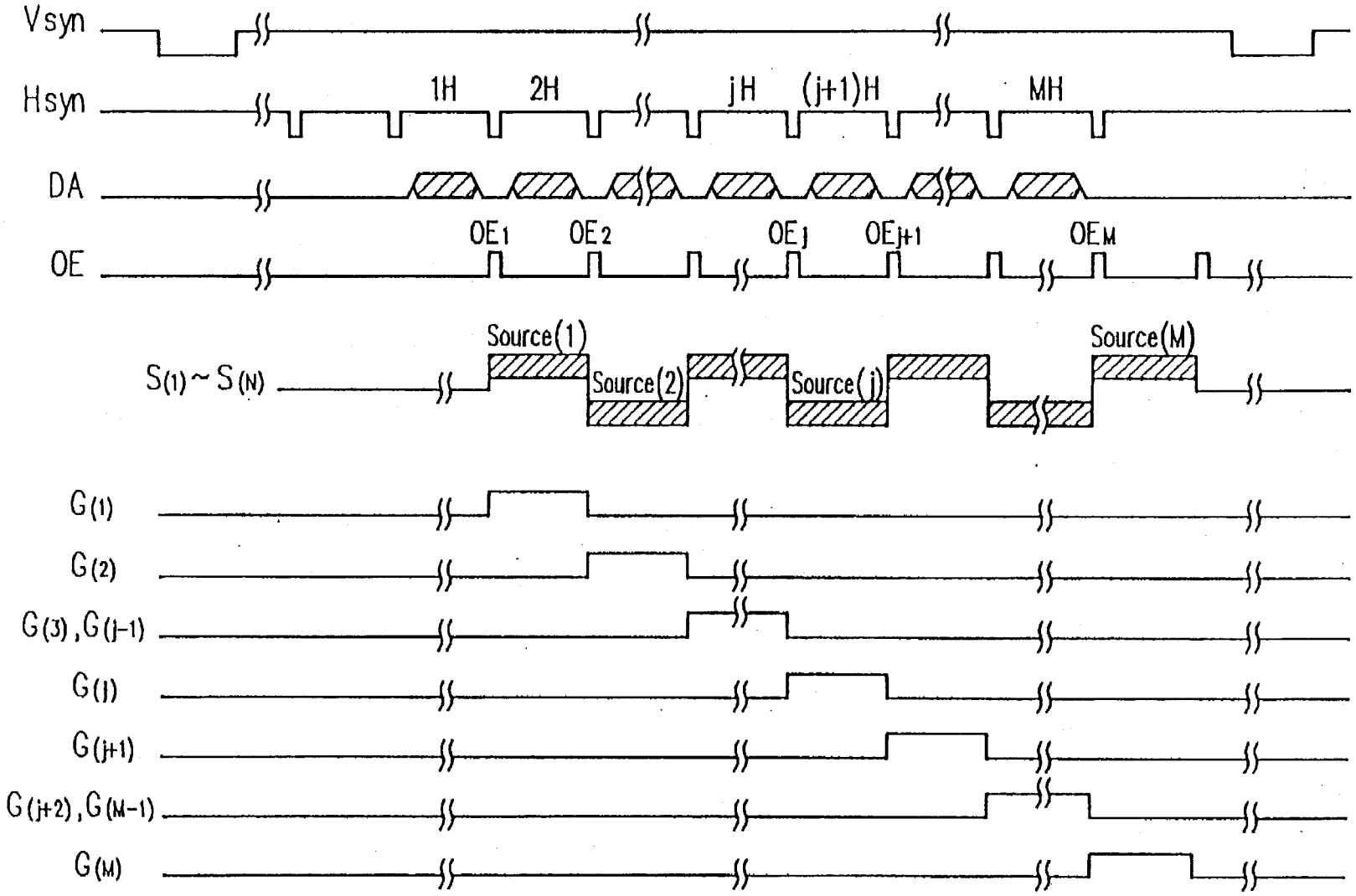
FIG. 3 is a timing diagram illustrating the relationship among input data, an output pulse, an output voltage, and a gate pulse in one vertical period.

FIG. 3 shows the relationship among the horizontal synchronizing signal $H_{syn}$, the digital video data DA, the output pulse signal OE, and the output timing of the data driver 102 and the output timing of the scanning driver 103, during one vertical period determined by a vertical synchronizing signal $V_{syn}$. In FIG. 3, a SOURCE(j) indicates a level range of voltages output from the data driver 102, with such timing as shown in FIG. 2 and in accordance with the digital video data applied during the horizontal period jH. The SOURCE (j) is shown as a hatched rectangular area to indicate a level range of voltages output from all the N output terminals S(1) to S(N) of the data driver 102. While the voltages indicated by the SOURCE(j) are applied to the data lines 106, the voltage which is output from the jth output terminal G(j) of the scanning driver 103 to the jth scanning line 107 is changed to and kept at a high level, thereby turning on all the N switching elements 105 connected to the jth scanning line 107. As a result, the N pixels 104 respectively connected to these N switching elements 105 are charged in accordance with the voltage applied to the corresponding data lines 106 from the data driver 102.

The above-described process is repeated M times, i.e., for the 1st to Mth scanning lines 107, so that an image corresponding to one vertical period is displayed. In the case of non-interlace type display apparatus, the produced image serves as a complete display image on the display screen thereof.

In this specification, the time interval between the jth output pulse $OE_j$ and the (j+1)th output pulse $OE_{j+1}$ in the output pulse signal OE is defined as "one output period". This means that one output period is equal to a period represented by SOURCE(j) shown in FIG. 3. In cases where usual line sequential scanning is performed, one output period is made equal to One horizontal period. The reason for this is as follows. While the data driver 102 outputs voltages corresponding to digital video data for one horizontal (scanning) line, to the data lines 106, it also performs sampling of digital video data for the next horizontal line. The maximum allowable length of time during which these voltages can be output from the data driver 102 is equal to one horizontal period. Furthermore, except for special cases, as the output period becomes longer, the pixels can be charged more accurately. In this specification, therefore, one output period is assumed to be equal to one horizontal period. According to the present invention, however, one output period is not necessarily required to be equal to one horizontal period.

Figure 4:
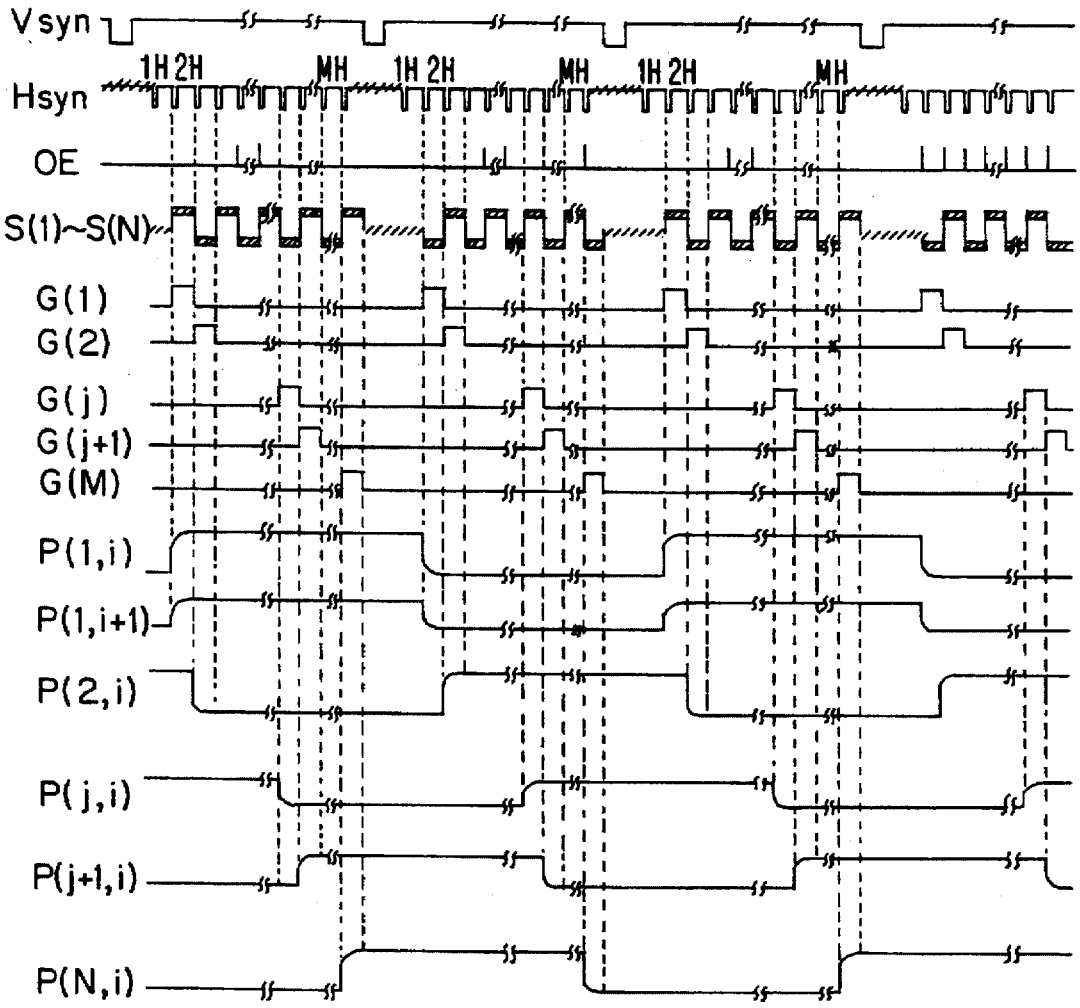
FIG. 4 is a timing diagram illustrating the relationship among input data, an output pulse, an output voltage, a gate pulse, and a voltage applied to a pixel in one vertical period.

FIG. 4 shows, in addition to the timing of the respective signals shown in FIGS. 2 and 3, the levels of voltages which are applied to the pixels P (j, i) (j=1, 2, . . . , M) in accordance with the timing.

Figure 5:
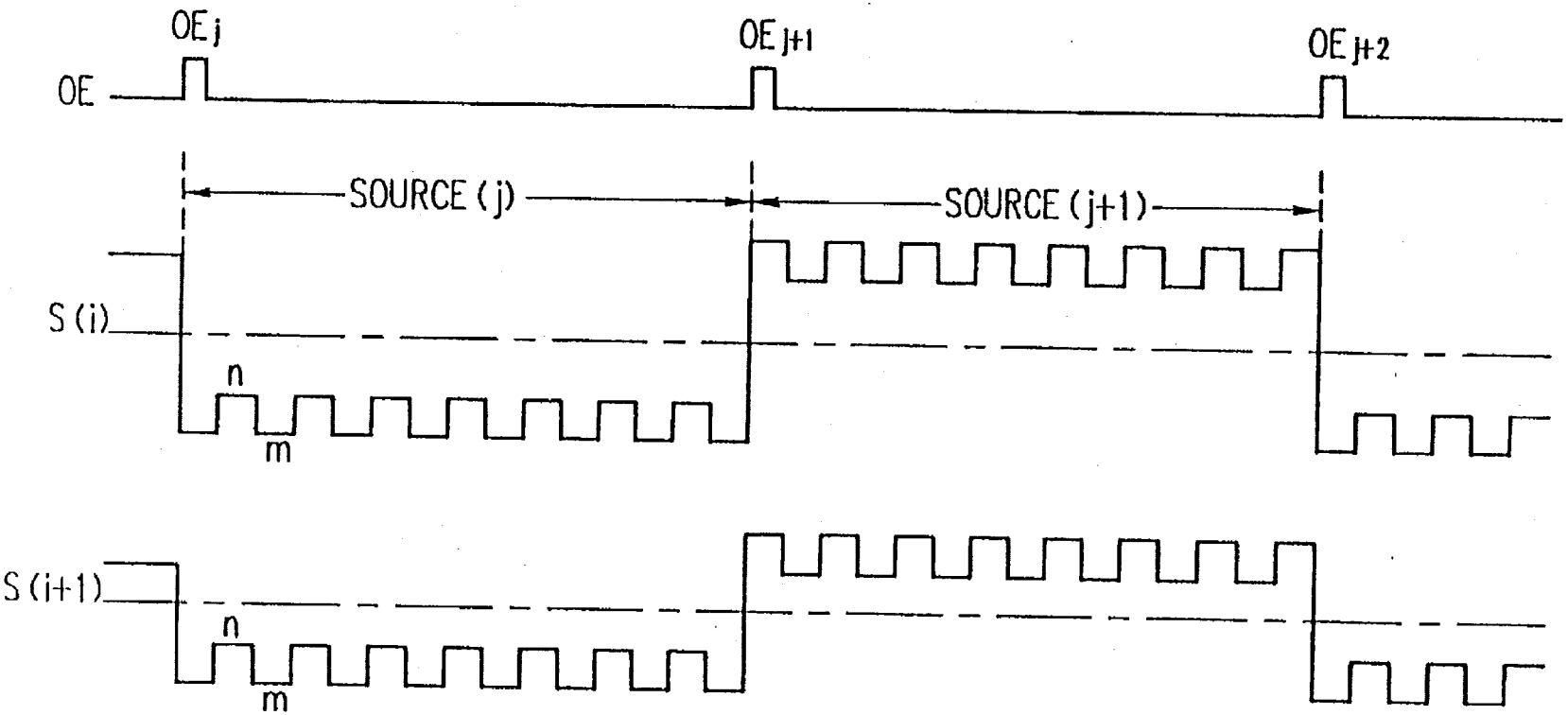
FIG. 5 is a waveform chart of an output voltage oscillating in one output period.

FIG. 5 shows an exemplary waveform for a voltage signal output from the data driver 102 to the data lines 106 in one output period. In the case of the conventional data driver, the voltage level of the voltage signal output to the data lines 106 is constant during one output period. On the other hand, from the data driver 102 in this example according to the invention, the voltage signal output to the data lines 106 includes an oscillating component which oscillates during one output period. As is shown in FIG. 5, the voltage signal is a pulse-like signal, and a ratio of a high-level period to a low-level period, i.e., a duty ratio n:m is selected as described below.

Figure 6:
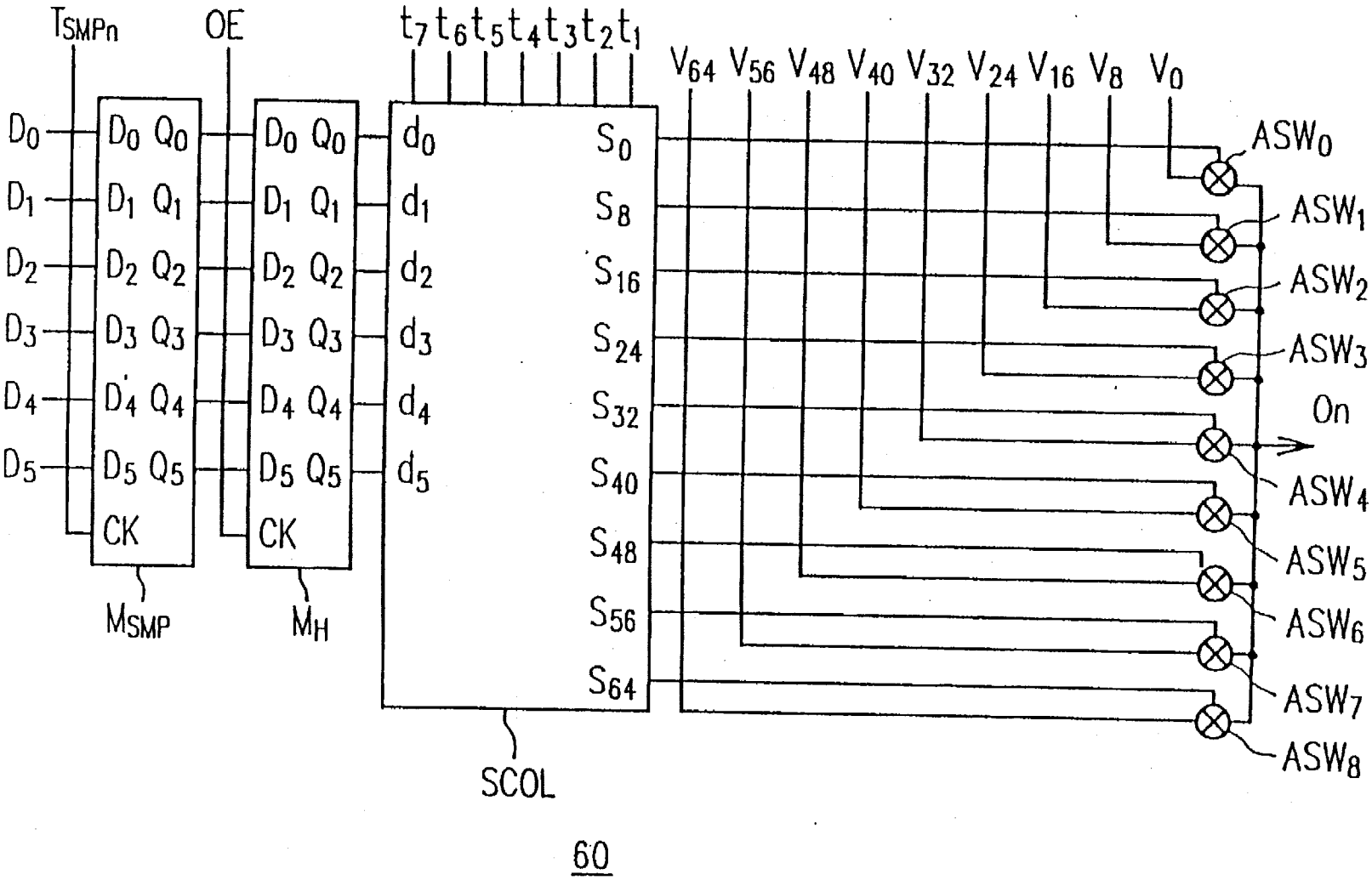
FIG. 6 is a diagram showing a part of a configuration for a data driver in a driving circuit in Example 1 according to an embodiment of the invention.

FIG. 6 shows a configuration for a part of the data driver 102 in the driving circuit 101. The circuit 60 shown in FIG. 6 outputs a video signal from an nth output terminal S(n) to one data line 106. The data driver 102 includes circuits 60 the number of which is equal to the number of the data lines 106 provided in the display section 100. Herein, it is assumed that the video data consists of 6 bits ($D_0$, $D_1$, $D_2$, $D_3$, $D_4$, $D_5$). On such an assumption, the video data may have 64 kinds of values of 0–63, and the voltage applied to each pixel is one of nine gray-scale voltages $V_0$, $V_8$, $V_{16}$, $V_{24}$, $V_{32}$, $V_{40}$, $V_{48}$, $V_{56}$, and $V_{64}$, or interpolated voltages which are produced from any pair of the gray-scale voltages chosen from $V_0$, $V_8$, $V_{16}$, $V_{24}$, $V_{32}$, $V_{40}$, $V_{48}$, $V_{56}$, and $V_{64}$.

The circuit 60 includes a sampling flip-flop $M_{SMP}$ which performs the sampling operation, a holding flip-flop $M_H$ which performs the holding operation, a selection control circuit SCOL, and analog switches $ASW_0$–$ASW_8$. To each of the analog switches $ASW_0$–$ASW_8$, a corresponding one of nine gray-scale voltages $V_0$, $V_8$, $V_{16}$, $V_{24}$, $V_{32}$, $V_{40}$, $V_{48}$, $V_{56}$, and $V_{64}$ is supplied. The gray-scale voltages $V_0$–$V_{64}$ have respective levels which are different from each other. The selection control circuit SCOL is supplied with seven oscillating signals $t_1$–$t_7$. The oscillating signals $t_1$–$t_7$ have respective duty ratios which are different from each other.

As the sampling flip-flop $M_{SMP}$ and the holding flip-flop $M_H$, for example, D-type flip-flops can be used. It is appreciated that such sampling and holding flip-flops can be realized by using other types of circuit elements.

Next, by referring to FIG. 6, the operation of the circuit 60 is described. At the rising of a sampling pulse $T_{SMPn}$ corresponding to the nth pixel, the sampling flip-flop $M_{SMP}$ gets video data ($D_0$, $D_1$, $D_2$, $D_3$, $D_4$, $D_5$), and holds the video data therein. When such video data sampling for one horizontal period is completed, an output pulse signal OE is applied to the holding flip-flop $M_H$. When the output pulse signal OE is applied, the video data held in the sampling flip-flop $M_{SMP}$ is fed into the holding flip-flop $M_H$ and output to the selection control circuit SCOL. The selection control circuit SCOL receives the video data, and produces a plurality of control signals in accordance with the value of the video data. The control signals are used for switching the ON/OFF states of the respective analog switches $ASW_0$–$ASW_8$. The video data input to the selection control circuit SCOL is represented by $d_0$, $d_1$, $d_2$, $d_3$, $d_4$, and $d_5$, and the control signals output from the selection control circuit SCOL are represented by $S_0$, $S_8$, $S_{16}$, $S_{24}$, $S_{32}$, $S_{40}$, $S_{48}$, $S_{56}$, and $S_{64}$.

Table 2 is a logical table for the lower three bits $d_2$, $d_1$, and $d_0$ of the 6-bit video data. The 1st to 3rd columns of Table 2 indicate the values of video data bits $d_2$, $d_1$, and $d_0$, respectively. The 4th to 11th columns of Table 2 indicate which oscillating signal is specified from the oscillating signals $t_0$–$t_7$. In the 4th to 11th columns of Table 2, the oscillating signal which is indicated by a value of 1 is specified. For example, in the case of ($d_2$, $d_1$, $d_0$)=(0, 0, 0), the oscillating signal $t_0$ is specified. In this example, the oscillating signals $t_0$–$t_7$ are clock signals having duty ratios of 8:0, 7:1, 6:2, 5:3, 4:4, 3:5, 2:6, and 1:7, respectively. Herein, if an oscillating signal has a duty ratio of k:0 or 0:k (k is a natural number), the oscillating signal is defined as always being at a fixed level. The oscillating signals $t_5$, $t_6$, and $t_7$ are the signals obtained by inverting the oscillating signals $t_3$, $t_2$, and $t_1$.

TABLE 2

| d2 | d1 | d0 | t0 | t1 | t2 | t3 | t4 | t5 | t6 | t7 |
|---|---|---|---|---|---|---|---|---|---|---|
| 0 | 0 | 0 | 1 | | | | | | | |
| 0 | 0 | 1 | | 1 | | | | | | |
| 0 | 1 | 0 | | | 1 | | | | | |
| 0 | 1 | 1 | | | | 1 | | | | |
| 1 | 0 | 0 | | | | | 1 | | | |
| 1 | 0 | 1 | | | | | | 1 | | |
| 1 | 1 | 0 | | | | | | | 1 | |
| 1 | 1 | 1 | | | | | | | | 1 |

From the logical table of Table 2, the following logical equation is obtained.

$$T=(0)t_0+(1)t_1+(2)t_2+(3)t_3+(4)t_4+(5)t_5+(6)t_6+(7)t_7 \quad (6)$$

In the above equation, (i) indicates a value of binary data ($d_2$, $d_1$, $d_0$) which is represented in a decimal notation. That is, (0)=($d_2$, $d_1$, $d_0$)=(0, 0, 0,), (1)=($d_2$, $d_1$, $d_0$)=(0, 0, 1), (2)=($d_2$, $d_1$, $d_0$) =(0, 1, 0), (3)=($d_2$, $d_1$, $d_0$)=(0, 1, 1), (4)=($d_2$, $d_1$, $d_0$)=(1, 0, 0), (5)=($d_2$, $d_1$, $d_0$)=(1, 0, 1), (6)=($d_2$, $d_1$, $d_0$)=(1, 1, 0), and (7)=($d_2$, $d_1$, $d_0$) =(1, 1, 1).

The oscillating signal $t_0$ is continually at a level of "1", so that Equation (6) can alternatively be represented as the following equation.

$$T=(0)+(1)t_1+(2)t_2+(3)t_3+(4)t_4+(5)t_5+(6)t_6+(7)t_7 \quad (7)$$

Table 3 is a logical table representing the relationships among the upper three bits $d_5$, $d_4$, and $d_3$ of the 6-bit video data, and the control signals $S_0$, $S_8$, $S_{16}$, $S_{24}$, $S_{32}$, $S_{40}$, $S_{48}$, $S_{56}$, and $S_{64}$. In Table 3, a variable T denotes a signal T which is defined by Equation (6) or (7). A variable T-bar denotes an inverted signal T-bar obtained by inverting the signal T.

TABLE 3

| d5 | d4 | d3 | S0 | S8 | S16 | S24 | S32 | S40 | S48 | S56 | S64 |
|---|---|---|---|---|---|---|---|---|---|---|---|
| 0 | 0 | 0 | T | $\bar{T}$ | | | | | | | |
| 0 | 0 | 1 | | T | $\bar{T}$ | | | | | | |
| 0 | 1 | 0 | | | T | $\bar{T}$ | | | | | |
| 0 | 1 | 1 | | | | T | $\bar{T}$ | | | | |
| 1 | 0 | 0 | | | | | T | $\bar{T}$ | | | |
| 1 | 0 | 1 | | | | | | T | $\bar{T}$ | | |

TABLE 3-continued

| d5 | d4 | d3 | S0 | S8 | S16 | S24 | S32 | S40 | S48 | S56 | S64 |
|---|---|---|---|---|---|---|---|---|---|---|---|
| 1 | 1 | 0 | | | | | | | T | $\bar{T}$ | |
| 1 | 1 | 1 | | | | | | | | T | $\bar{T}$ |

From the logical table of Table 3, the following logical equations are obtained.

$$S_0=[0]T \quad (8)$$

$$S_8=[0]\text{“}T\text{”}+[8]T \quad (9)$$

$$S_{16}=[8]\text{“}T\text{”}+[16]T \quad (10)$$

$$S_{24}=[16]\text{“}T\text{”}+[24]T \quad (11)$$

$$S_{32}=[24]\text{“}T\text{”}+[32]T \quad (12)$$

$$S_{40}=[32]\text{“}T\text{”}+[40]T \quad (13)$$

$$S_{48}=[40]\text{“}T\text{”}+[48]T \quad (14)$$

$$S_{56}=[48]\text{“}T\text{”}+[56]T \quad (15)$$

$$S_{64}=[56]\text{“}T\text{”} \quad (16)$$

In the above equations, [i] may be a value of logic-0 or logic-1, and j is a value of binary data ($d_5$, $d_4$, $d_3$) which is represented in a decimal notation. When i=(8×j), [i]=logic-1, and otherwise [i]=logic-0. For example, [8]="$d_5$"·"$d_4$"·$d_3$. In addition, "T" denotes an inverted signal of the signal T.

In accordance with the respective logical equations which are described above, logical circuits 70, 80, 90, and 95 shown in FIGS. 7 through 10 are obtained. The selection control circuit SCOL is constructed for example, by the logical circuits 70, 80, 90, and 95 shown in FIGS. 7 through 10.

Figure 7:
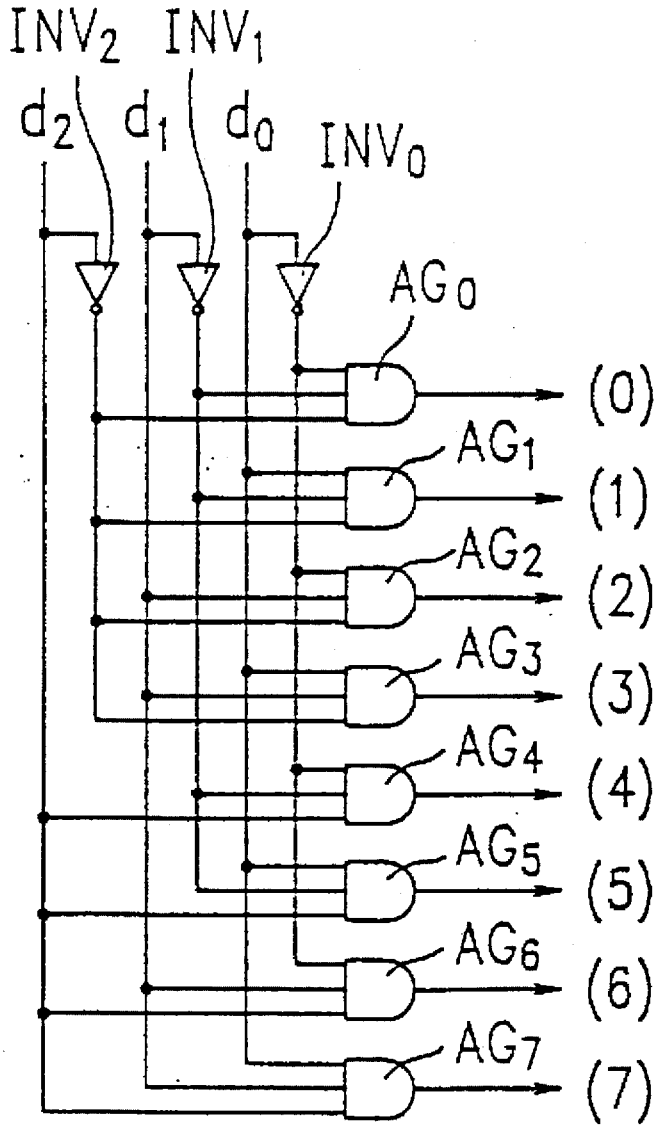
FIG. 7 is a diagram showing a part of a configuration for a selection control circuit SCOL in the driving circuit in Example 1 according to an embodiment of the invention.

The logical circuit 70 shown in FIG. 7 selectively outputs oscillating signal specifying signals (0)–(7) for specifying one of a plurality of oscillating signals $t_0$–$t_7$, in accordance with the lower 3 bits $d_2$, $d_1$, and $d_0$ of the video data. More specifically, the video data $d_2$, $d_1$, and $d_0$ and the inverted signals which are respectively obtained by inverting the video data $d_2$, $d_1$, and $d_0$ by inverter circuits $INV_0$, $INV_1$, and $INV_2$ are input into AND circuits $AG_0$–$AG_7$ in such combinations that constitute 0–7 in binary notation. The oscillating signal specifying signals (0)–(7) are thus obtained as the outputs of the AND circuits $AG_0$–$AG_7$.

Figure 8:
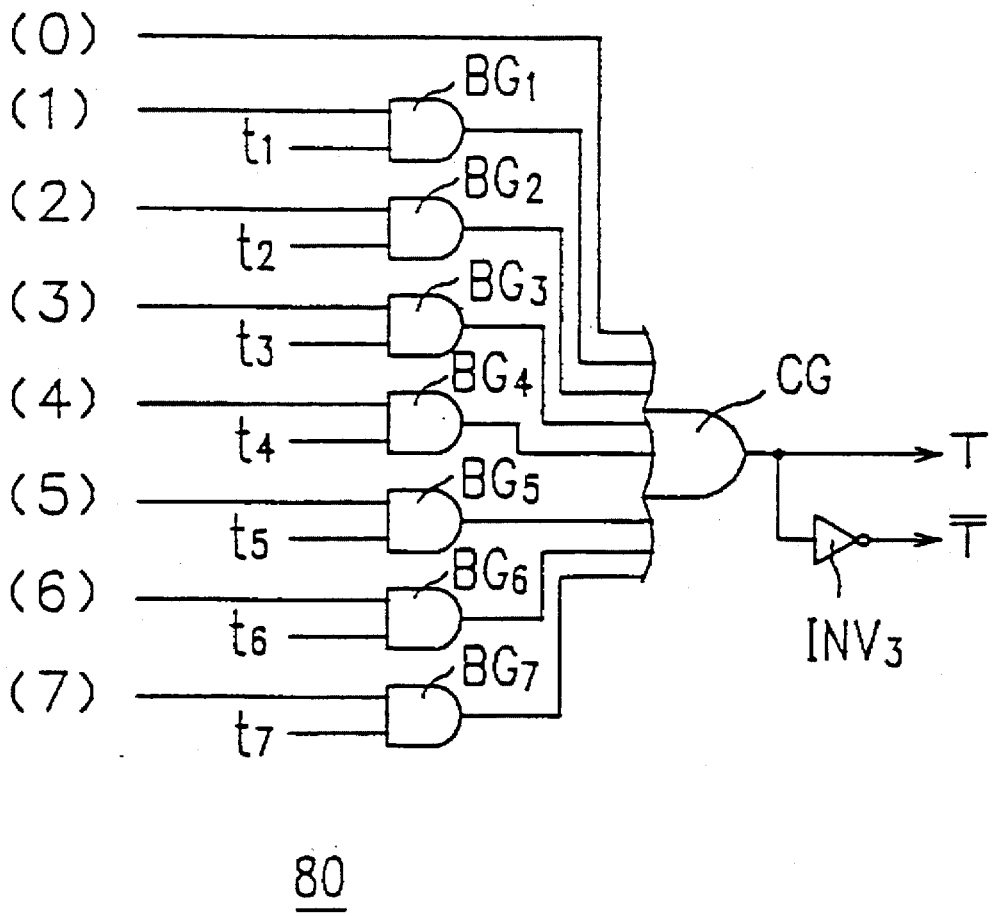
FIG. 8 is a diagram showing another part of the configuration of the selection control circuit SCOL in the driving circuit in Example 1 according to an embodiment of the invention.

The logical circuit 80 shown in FIG. 8 specifies one of the plurality of oscillating signals $t_0$–$t_7$ in accordance with the oscillating signal specifying signals, and produces the specified oscillating signal T and the inverted oscillating signal T-bar which is obtained by inverting the specified oscillating signal T by an inverter circuit $INV_3$. More specifically, the oscillating signal specifying signals (0)–(7) and the oscillating signals $t_1$–$t_7$ are input into AND circuits $BG_1$–$BG_7$, respectively, as is shown in FIG. 8. The outputs of the AND circuits $BG_1$–$BG_7$ are supplied to an OR circuit CG. The oscillating signal T and the inverted oscillating signal T-bar are obtained as the output of the OR circuit CG.

Figure 9:
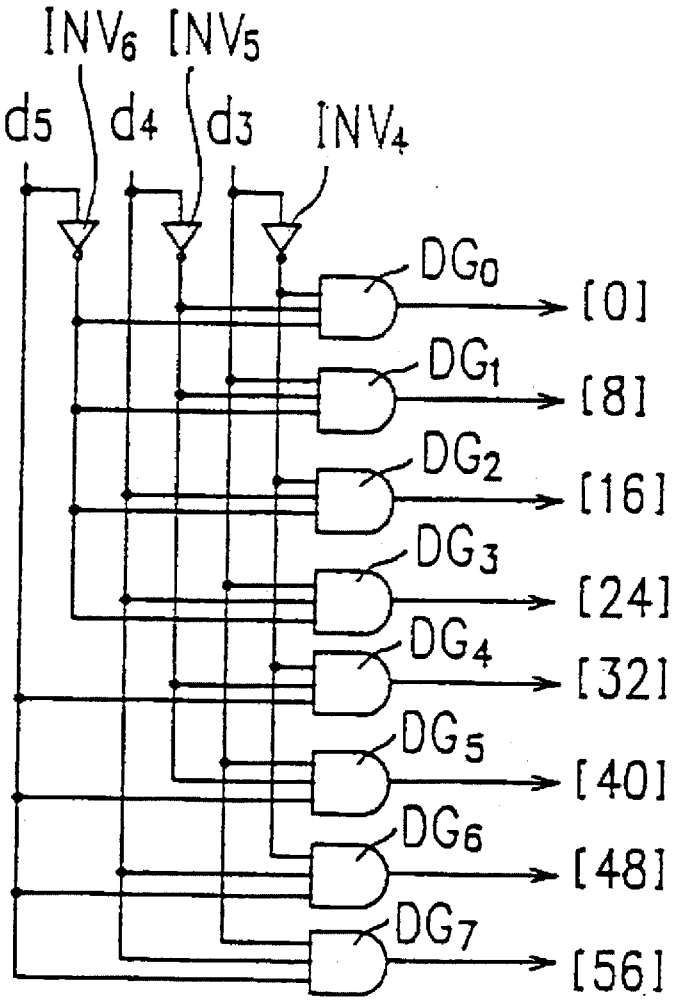
FIG. 9 is a diagram showing another part of the configuration of the selection control circuit SCOL in the driving circuit in Example 1 according to an embodiment of the invention.

The logical circuit 90 shown in FIG. 9 selectively outputs pray-scale voltage specifying signals [0], [8], [16], [24], [32], [40], [48], and [56] for specifying a pair of gray-scale voltages from among a plurality of pray-scale voltages, in accordance with the upper three bits $d_5$, $d_4$, and $d_3$ of the video data. More specifically, the video data $d_5$, $d_4$, and $d_3$ and the inverted signals which are respectively obtained by inverting the video data $d_5$, $d_4$, and $d_3$ by inverter circuits $INV_6$, $INV_5$, and $INV_4$ are input to AND circuits $DG_0$–$DG_7$ in such combinations which constitute 0–7 in the binary notation. As the outputs of the AND circuits $DG_0$–$DG_7$, the pray-scale voltage specifying signals [0], [8], [16], [24], [32], [40], [48], and [56]are obtained.

Figure 10:
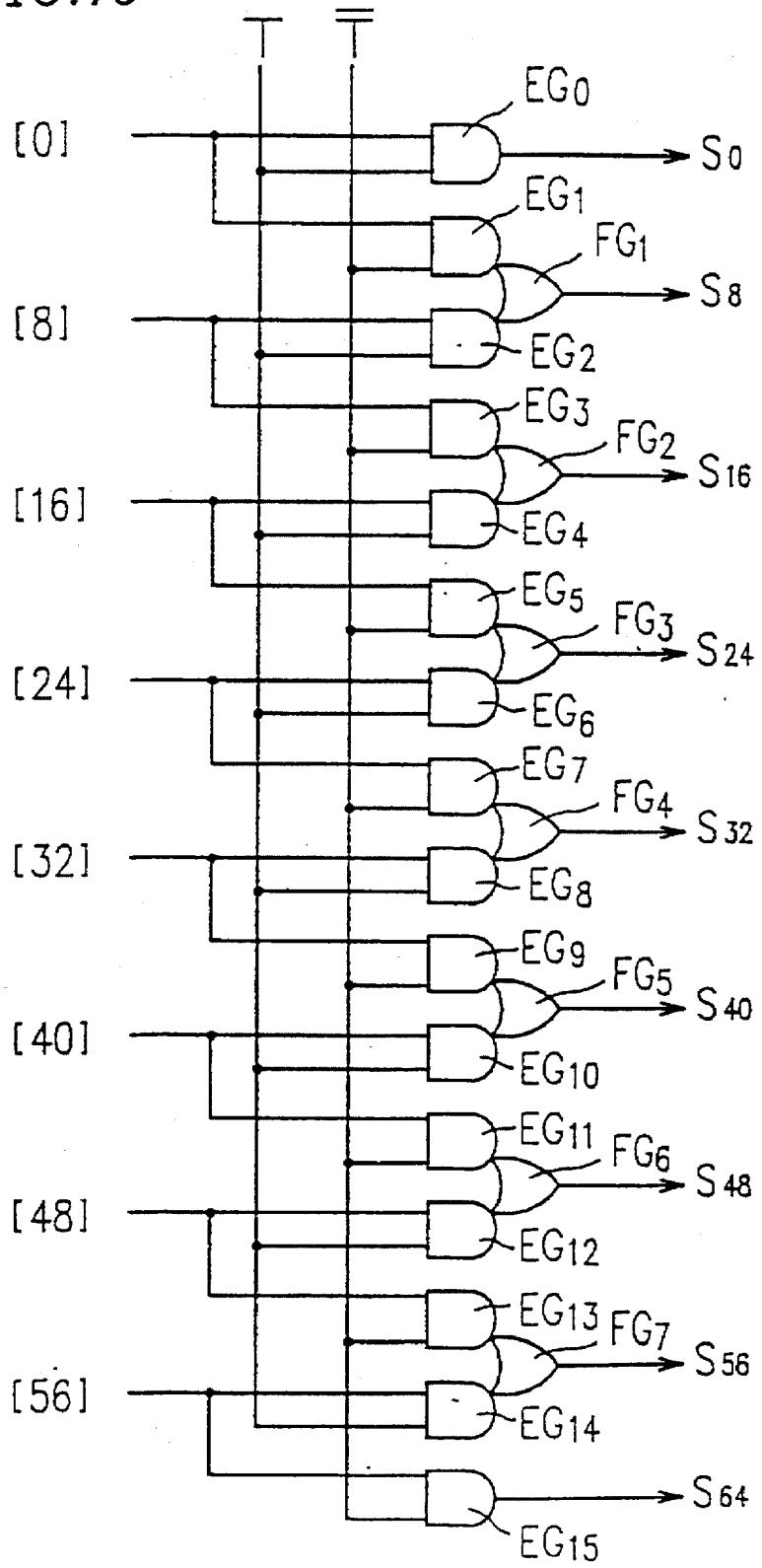
FIG. 10 is a diagram showing another part of the configuration of the selection control circuit SCOL in the driving circuit in Example 1 according to an embodiment of the invention.

The logical circuit 95 shown in FIG. 10 selectively outputs the control signals $S_0$–$S_{64}$, in accordance with the gray-scale voltage specifying signals [0], [8], [16], [24], [32], [40], [48], and [56], the oscillating signal T, and the inverted oscillating signal T-bar. More specifically, the gray-scale voltage specifying signals [0], [8], [16], [24], [32], [40], [48], and [56], and the oscillating signal T are input into AND circuits $EG_0$, $EG_2$, $EG_4$, $EG_6$, $EG_8$, $EG_{10}$, $EG_{12}$, and $EG_{14}$, respectively. The pray-scale voltage specifying signals [0], [8], [16], [24], [32], [40], [48], and [56] and the inverted oscillating signal T-bar are input into AND circuits $EG_1$, $EG_3$, $EG_5$, $EG_7$, $EG_9$, $EG_{11}$, $EG_{13}$, and $EG_{15}$, respectively. The outputs of the AND circuits $EG_1$ and $EG_2$ are coupled to the inputs of an OR circuit $FG_1$, respectively. The outputs of the AND circuits $EG_3$ and $EG_4$ are coupled to the inputs of an OR circuit $FG_2$, respectively. The outputs of the AND circuits $EG_5$ and $EG_6$ are coupled to an OR circuit $FG_3$, respectively. The outputs of the AND circuits $EG_7$ and $EG_8$ are coupled to the inputs of an OR circuit $FG_4$, respectively. The outputs of the AND circuits $EG_9$ and $EG_{10}$ are coupled to the inputs of an OR circuit $FG_5$, respectively. The outputs of the AND circuits $EG_{11}$ and $EG_{12}$ are coupled to the inputs of an OR circuit $FG_6$, respectively. The outputs of the AND circuits $EG_{13}$ and $EG_{14}$ are coupled to the inputs of an OR circuit $FG_7$, respectively. As the outputs of the AND circuit $EG_0$, the OR circuits $FG_1$–$FG_7$, and the AND circuit $EG_{15}$, the control signals $S_0$, $S_8$, $S_{16}$, $S_{24}$, $S_{32}$, $S_{40}$, $S_{48}$, $S_{56}$, and $S_{64}$ are obtained.

The control signals $S_0$, $S_8$, $S_{16}$, $S_{24}$, $S_{32}$, $S_{40}$, $S_{48}$, $S_{56}$, and $S_{64}$ are supplied to the corresponding analog switches $ASW_0$–$ASW_8$. Each of the control signals $S_0$, $S_8$, $S_{16}$, $S_{24}$, $S_{32}$, $S_{40}$, $S_{48}$, $S_{56}$, and $S_{64}$ has either a high-level value or a low-level value. For example, if the control signal is at a high level, the corresponding analog switch is controlled to be in the ON-state. If the control signal is at a low level, the corresponding analog switch is controlled to be in the OFF-state. Alternatively, the relationship between the level of the control signal and the ON/OFF state of the analog signal can be set in a reverse manner.

As described above, in the case where video data consists of a plurality of bits, a waveform of an oscillating voltage is specified in accordance with video data consisting of at least one bit selected from the plurality of bits. Then, in accordance with video data consisting of bits other than the above selected bit(s), a pair of gray-scale voltages are specified from a plurality of gray-scale voltages. As a result, a voltage signal of an appropriate level can be output for every value of video data. The oscillating voltage is used for realizing a plurality of interpolated gray-scale voltages between the specified pair of gray-scale voltages which are specified from among the plurality of gray-scale voltages.

In the case where the value of the video data is a multiple of 8, only one of the plurality of gray-scale voltages may be output. In such a case, the duty ratio n:m of the oscillating signal or the control signal is interpreted to be k:0 or 0:k (k is a natural number).

Alternatively, regardless of whether the value of the video data is a multiple of 8 or not, the specified pair of gray-scale voltages among the plurality of gray-scale voltages may be alternately output.

In the case where such an oscillating voltage is output to the data line of the display apparatus, the AC component of the oscillating voltage is suppressed due to the characteristics of a low-pass filter based on a resistance component and a capacitance component existing between the data line and the pixel. As a result, a voltage which is substantially equal to a mean value of the oscillating voltage is applied to the pixel. Thus, it is possible to attain the same effects as those in the case where a DC voltage is output to the data line of the display apparatus.

Figure 22:
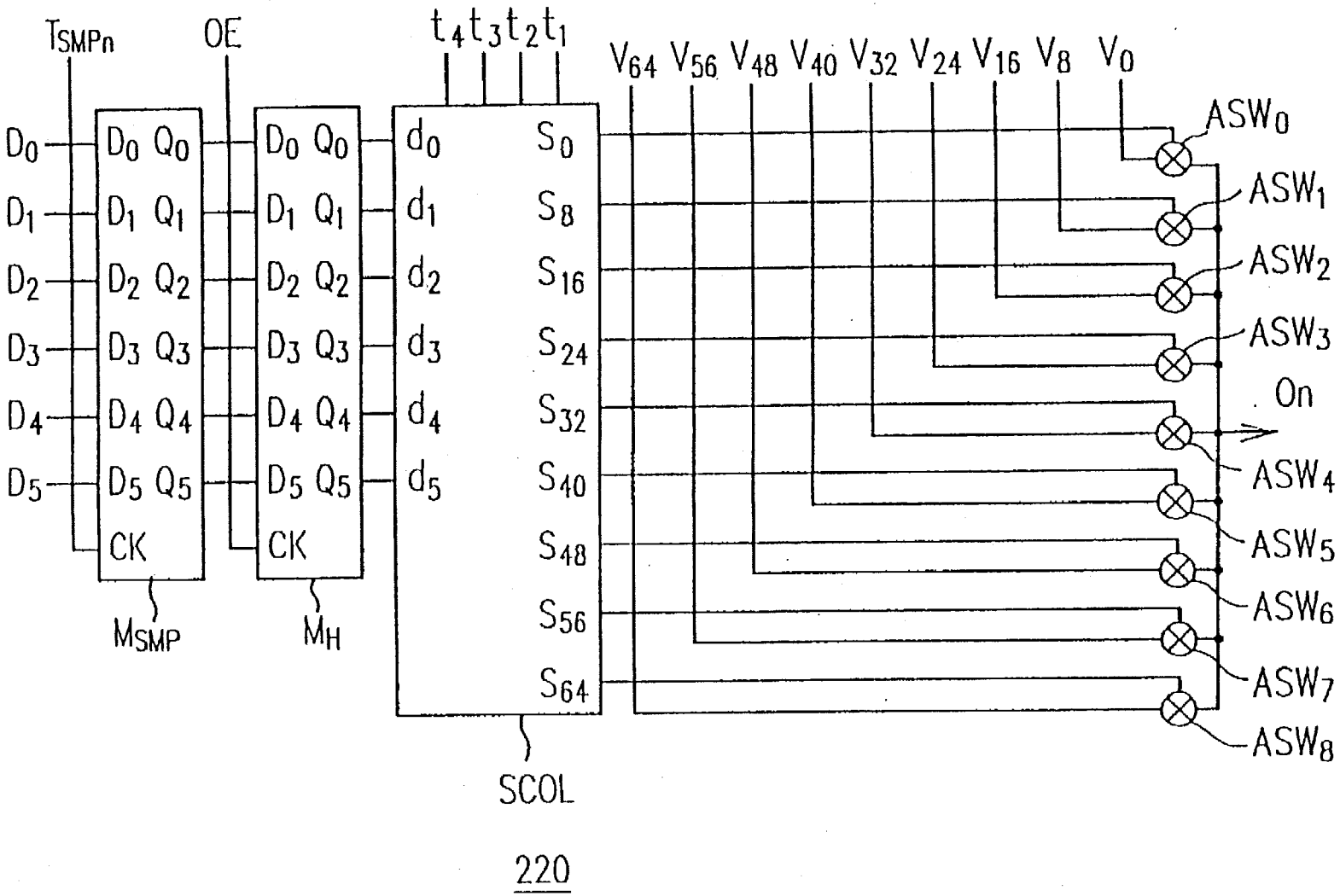
FIG. 22 PRIOR ART
FIG. 22 is a diagram showing a part of a configuration of a data driver in a driving circuit of a related art.
Figure 23:
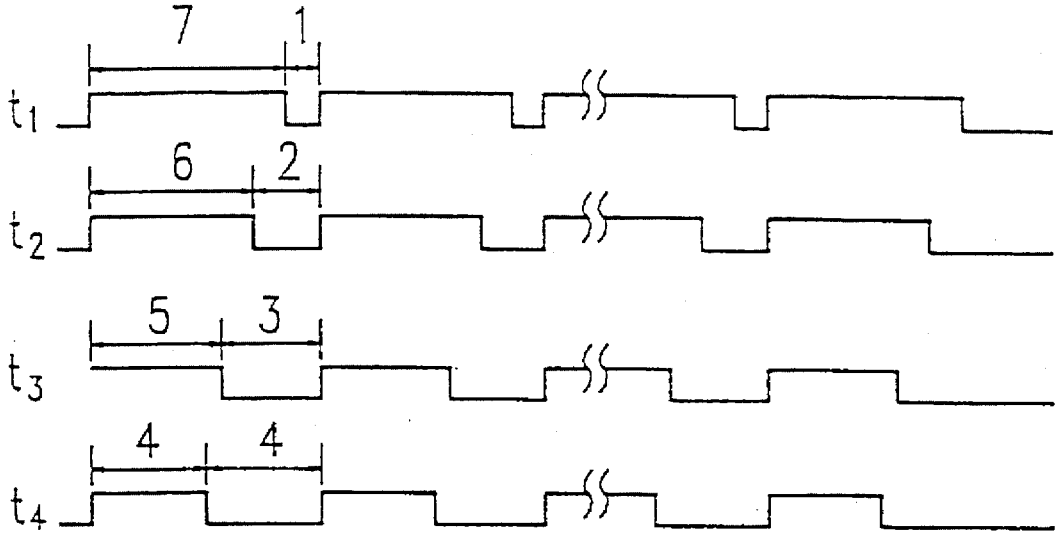
FIG. 23 PRIOR ART
FIG. 23 is a waveform chart of signals $t_1$–$t_4$ supplied to a selection control circuit SCOL in a conventional driving circuit.
Figure 24:
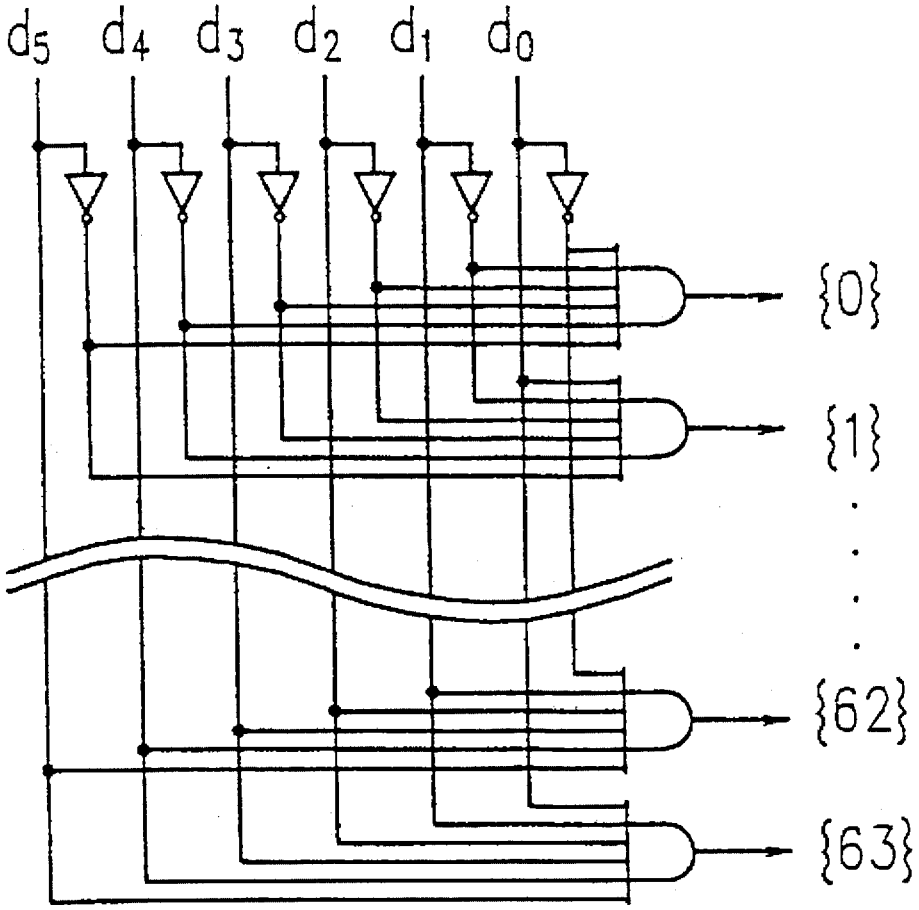
FIG. 24 PRIOR ART
FIG. 24 is a diagram showing a part of a configuration of a selection control circuit SCOL in a conventional driving circuit.
Figure 25:
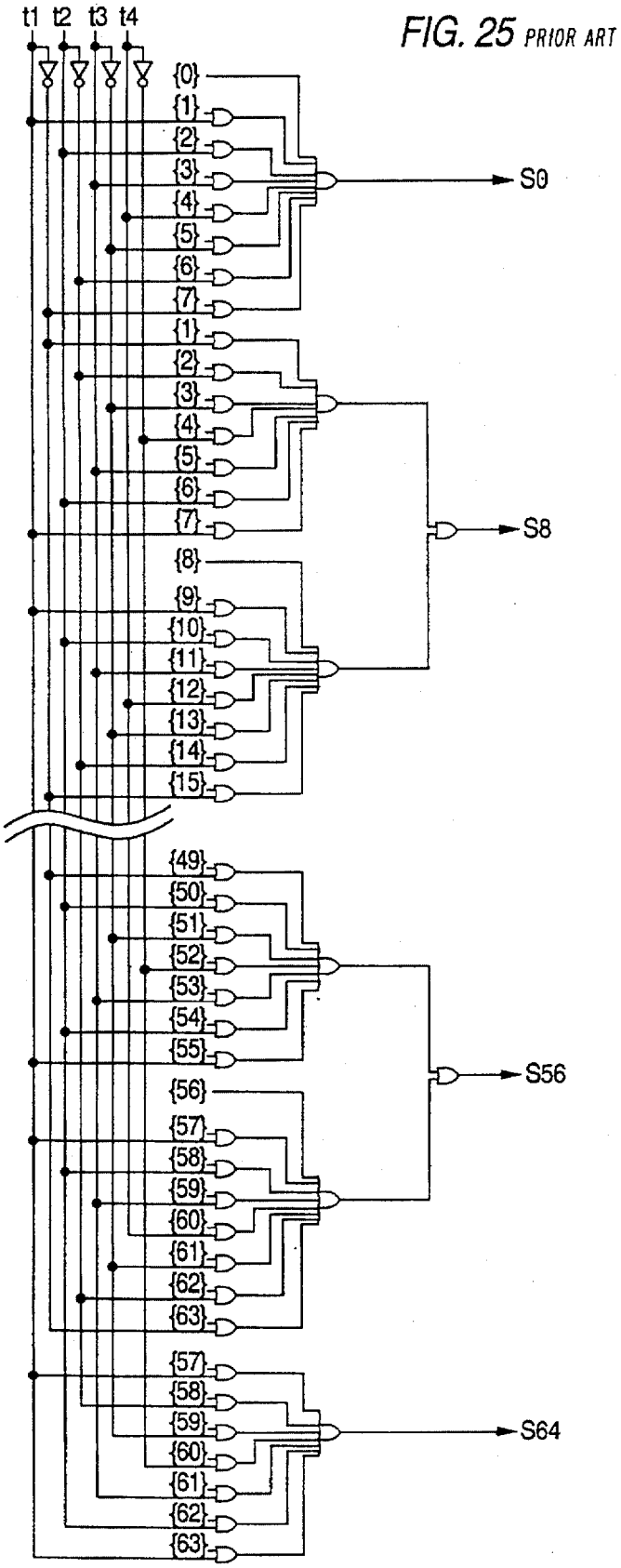
FIG. 25 PRIOR ART
FIG. 25 is a diagram showing another part of the configuration of a selection control circuit SCOL in a conventional driving circuit.

As described above, the selection control circuit SCOL according to the invention constructed of the logical circuits 70, 80, 90, and 95 shown in FIGS. 7 through 10 has a simplified construction as compared with the conventional selection control circuit SCOL shown in FIG. 22 which is constructed of the logical circuits shown in FIGS. 24 and 25. According to the invention, it is possible to display an image with multiple gray scales, such as 64 gray scales, by using a driving circuit having a more simplified construction. For example, in order to realize a display image with 64 gray scales, only 9 kinds of gray-scale voltages are required.

In the oscillating signals $t_1$–$t_7$, the oscillating signals $t_5$–$t_7$ are the signals inverted from the oscillating signals $t_1$–$t_3$. Therefore, by inverting the oscillating signals $t_1$–$t_3$, the oscillating signals $t_5$–$t_7$ are obtained in the inside of the selection control circuit SCOL. In such a case, it is sufficient to supply only the oscillating signals $t_1$–$t_4$ to the selection control circuit SCOL. Thus, it is possible to reduce the number of lines for supplying the oscillating signals to the selection control circuit SCOL.

The actual data driver requires selection control circuits SCOL the number of which is equal to the number of data lines. Thus, the circuit scale of the selection control circuits SCOL largely affects the chip size of an integrated circuit (LSI) on which a data driver is installed. According to the invention, it is possible to significantly reduce the size of the integrated circuit including the selection control circuits SCOL. As a result, the production cost of the integrated circuit can be decreased. In cases where the number of bits of video data is increased in order to realize an image of high resolution, such miniaturization of the circuit scale of the data driver is of great use. Accordingly, it is possible to make further progress in the size and cost reduction of the integrated circuit.

In the driving circuit in Example 1 described above, a pair of gray-scale voltages are specified from the plurality of gray-scale voltages, based on the upper three bits $D_5$, $D_4$, and $D_3$ of the 6-bit video data $D_0$, $D_1$, $D_2$, $D_3$, $D_4$, and $D_5$. A pair of analog switches corresponding to the specified pair of gray-scale voltages are driven at a duty ratio corresponding to the lower three bits $D_2$, $D_1$, and $D_0$. However, the invention is not limited to this manner.

In general, the present invention can be applied to a driving circuit for driving a display apparatus in accordance with (x+y) bits. The display apparatus displays an image with $2^{(x+y)}$ gray scales. Herein, x and y are desired positive integers. In the driving circuit according to the invention, a pair of gray-scale voltages among a plurality of gray-scale voltages are specified, based on a value represented by the upper x bits. The required number of gray-scale voltages is $(2^x+1)$, and a gray-scale voltage pair is specified from $2^x$ gray-scale voltage pairs. A pair of analog switches corresponding to the specified gray-scale voltages are driven at a duty ratio corresponding to a value represented by the lower y bits. As a result, between the specified pair of gray-scale voltages, $(2^y-1)$ intermediate voltages can be obtained. Therefore, the number of obtainable intermediate voltage is $2^x(2^y-1)$. The mean values of these intermediate voltages are different from each other.

In order to display an image with 64 gray scales, x and y are selected to be 3 and 3, respectively. This is identical with the above described example. In such a case, $9(=2^3+1)$ gray-scale voltages are supplied to the respective analog switches. Based on a value represented by the upper three bits, a gray-scale voltage pair is specified from $8(=2^3)$ gray-scale voltage pairs. A pair of analog switches corresponding to the specified pair of gray-scale voltages are driven at a duty ratio corresponding to a value represented by the lower three bits. Such a driving requires $7(=2^3-1)$ oscillating signals having mean values which are different from each other. However, three of the seven oscillating signals are obtained by inverting the other oscillating signals. Therefore, the number of oscillating signals which are actually required is 4(=7–3). Accordingly, it is possible to obtain $7(=2^3-1)$ intermediate voltages between the specified pair of gray-scale voltages.

Similarly, in order to display an image with 256 gray scales, x and y are selected to be 3 and 5, respectively. In such a case, $9(=2^3+1)$ gray-scale voltages are supplied to the respective analog switches. Based on a value represented by the upper three bits, a gray-scale voltage pair is specified from $8(=2^3)$ gray-scale voltage pairs. A pair of analog switches corresponding to the specified pair of gray-scale voltages are driven at a duty ratio corresponding to a value represented by the lower five bits. Such a driving requires $31(=2^5-1)$ oscillating signals having mean values which are different from each other. However, fifteen of the thirty-one oscillating signals are obtained by inverting the other oscillating signals. Therefore, the number of oscillating signals which are actually required is 16(=31–15). Accordingly, it is possible to obtain $31(=2^5-1)$ intermediate voltages between the specified pair of gray-scale voltages.

EXAMPLE 2

As described above, when the video data is composed of 6 bits, it is necessary to supply 7 oscillating signals $t_1$–$t_7$ to the selection control circuit SCOL. However, the oscillating signals $t_5$–$t_7$ are obtained by inverting the oscillating signals $t_1$–$t_3$, so that it is sufficient to supply only four oscillating signals $t_1$–$t_4$ to the selection control circuit SCOL. As the number of bits of the video data increases, the required number of oscillating signals also increases. This results in the increase in number of lines for supplying the oscillating signals to the selection control circuit SCOL. For example, when the video data is composed of 8 bits, 31 oscillating signals $t_1$14 $t_{31}$ are required. Even if the inverted signals are utilized, 16 oscillating signals $t_1$–$t_{16}$ are required.

The aim of the driving circuit of this example is to reduce the number of oscillating signals. Hereinafter, the configuration of the driving circuit of this example will be described.

Figure 11:
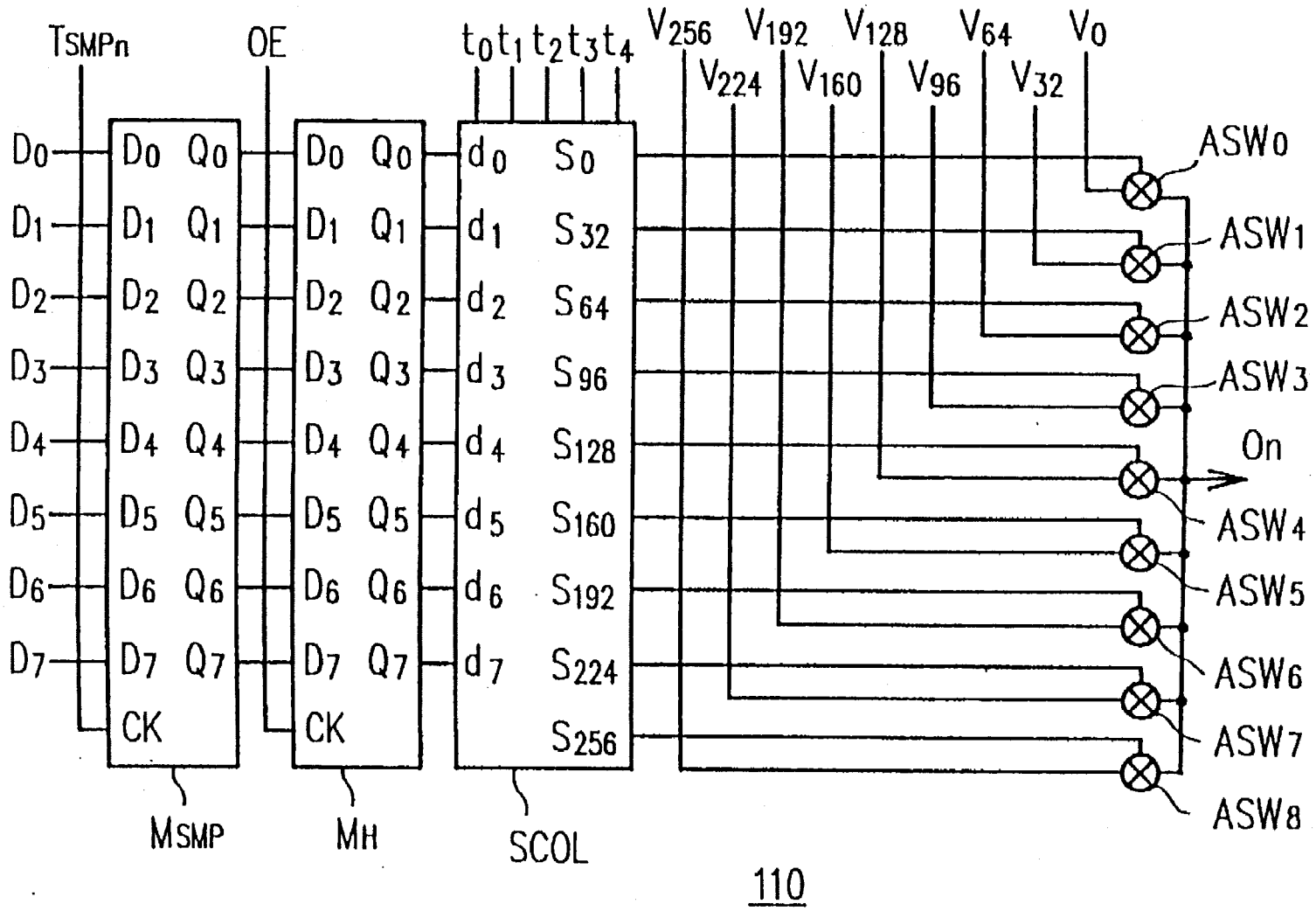
FIG. 11 is a diagram showing a part of a configuration for a data driver in a driving circuit in Example 2 according to an embodiment of the invention.

FIG. 11 shows the configuration of a circuit corresponding to one output of an 8-bit data driver. The configuration is similar to that of the circuit 60 shown in FIG. 6, so that the detailed description thereof is omitted. To the selection control circuit SCOL, oscillating signals $t_0$–$t_4$ are supplied. These oscillating signals may be generated in the driving circuit or may be input from the outside of the driving circuit. The selection control circuit SCOL has an oscillating signal generation circuit for combining a required number of oscillating signals based on the oscillating signals $t_0$–$t_4$.

Figure 12:
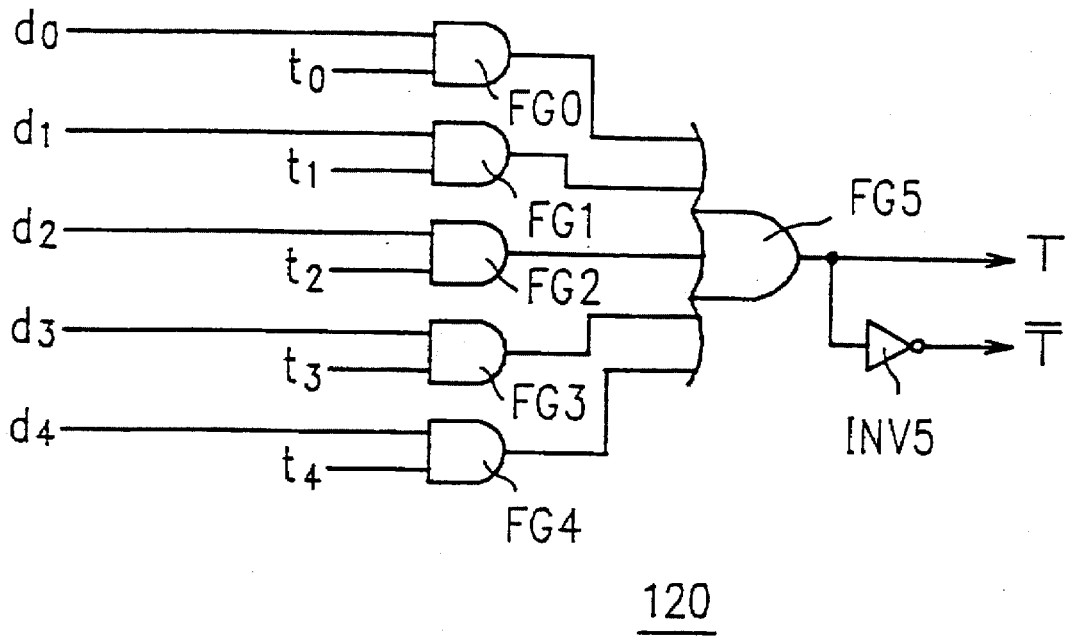
FIG. 12 is a diagram showing a configuration of an oscillating signal generation circuit in the driving circuit in Example 2 according to an embodiment of the invention.

FIG. 12 shows the configuration of the oscillating signal generation circuit 120. The oscillating signal generation circuit 120 includes AND circuits $FG_0$–$FG_4$ and an OR circuit $FG_5$. The AND circuit $FG_0$–$FG_4$ receive the lower five bits ($d_0$, $d_1$, $d_2$, $d_3$, $d_4$) of the 8-bit video data, respectively. The AND circuits $FG_0$–$FG_4$ also receive the oscillating signals $t_0$–$t_4$, respectively. The outputs of the AND circuits $FG_0$–$FG_4$ are coupled to the inputs of the OR circuit $FG_5$. With this configuration, the oscillating signal ($t_0$–$t_4$) can pass through the corresponding AND circuit ($FG_0$–$FG_4$), only when the received bit is 1. The oscillating signals passed through the AND circuits $FG_0$–$FG_4$ are logically added to each other by the OR circuit $FG_5$. The output of the OR circuit $FG_5$ is an oscillating signal T. Also, an inverted oscillating signal T-bar is obtained by an inverter $INV_5$.

Each of the oscillating signals $t_0$–$t_4$ is either a high-level value or a low-level value. The oscillating signals $t_0$–$t_4$ are required to satisfy the following conditions.

(1) The high-level periods of the oscillating signals $t_0$–$t_4$ are not overlapped in one cycle.

(2) The lengths of the high-level periods of the oscillating signals $t_0$–$t_4$ in one cycle are weighted in accordance with the corresponding bits of the lower five bits.

It is easily appreciated by a person having ordinary skill in the art that the "high-level" can be replaced with the "low-level" in the conditions (1) and (2).

Figure 13:
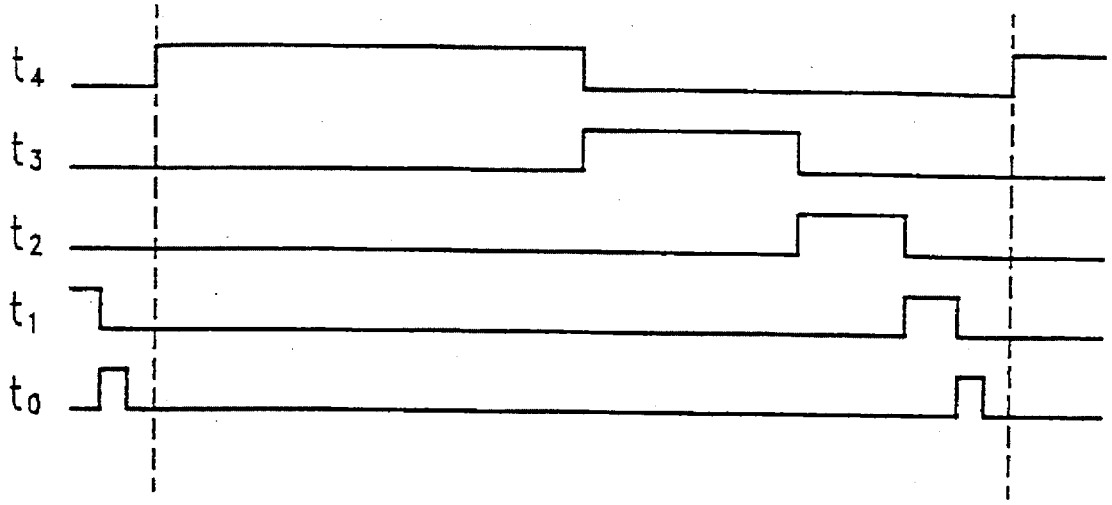
FIG. 13 is a waveform chart of oscillating signals used by the oscillating signal generation circuit.

FIG. 13 shows exemplary waveforms of the oscillating signals $t_0$–$t_4$. In this example, the oscillating signals $t_0$–$t_4$ correspond to the lower five bits $d_0$–$d_4$ of the 8-bit video data, respectively. The lower five bits $d_0$–$d_4$ correspond to $2^0$–$2^4$, respectively. Accordingly, the lengths of the high-level periods of the oscillating signals $t_0$–$t_4$ in one cycle are weighted in accordance with $2^0$–$2^4$. In this example, if the length of the high-level period of the oscillating signal $t_0$ is assumed to be 1(=$2^0$), the length of the high-level period of the oscillating signal $t_1$ in one cycle is 2(=$2^1$), the length of the high-level period of the oscillating signal $t_2$ in one cycle is 4(=$2^2$), the length of the high-level period of the oscillating signal $t_3$ in one cycle is 8(=$2^3$), and the length of the high-level period of the oscillating signal $t_4$ in one cycle is 16(=$2^4$). As a result, the mean values of the oscillating signals $t_0$–$t_4$ in one cycle are 1/32, 2/32, 4/32, 8/32, and 16/32, respectively, assuming that, if the signal is kept at the high level in one cycle, the mean value of the signal is 1.

By combining the oscillating signal $t_0$–$t_4$ in accordance with a value represented by the lower five bits $d_0$–$d_4$, the oscillating signal generation circuit generates oscillating signals T having respective mean values corresponding to values represented by the lower five bits $d_0$–$d_4$. As described above, the oscillating signals $t_0$–$t_4$ are used as bases for generating a plurality of oscillating signals T. In this specification, the oscillating signals $t_0$–$t_4$ are referred to as "original oscillating signals".

Figure 14:
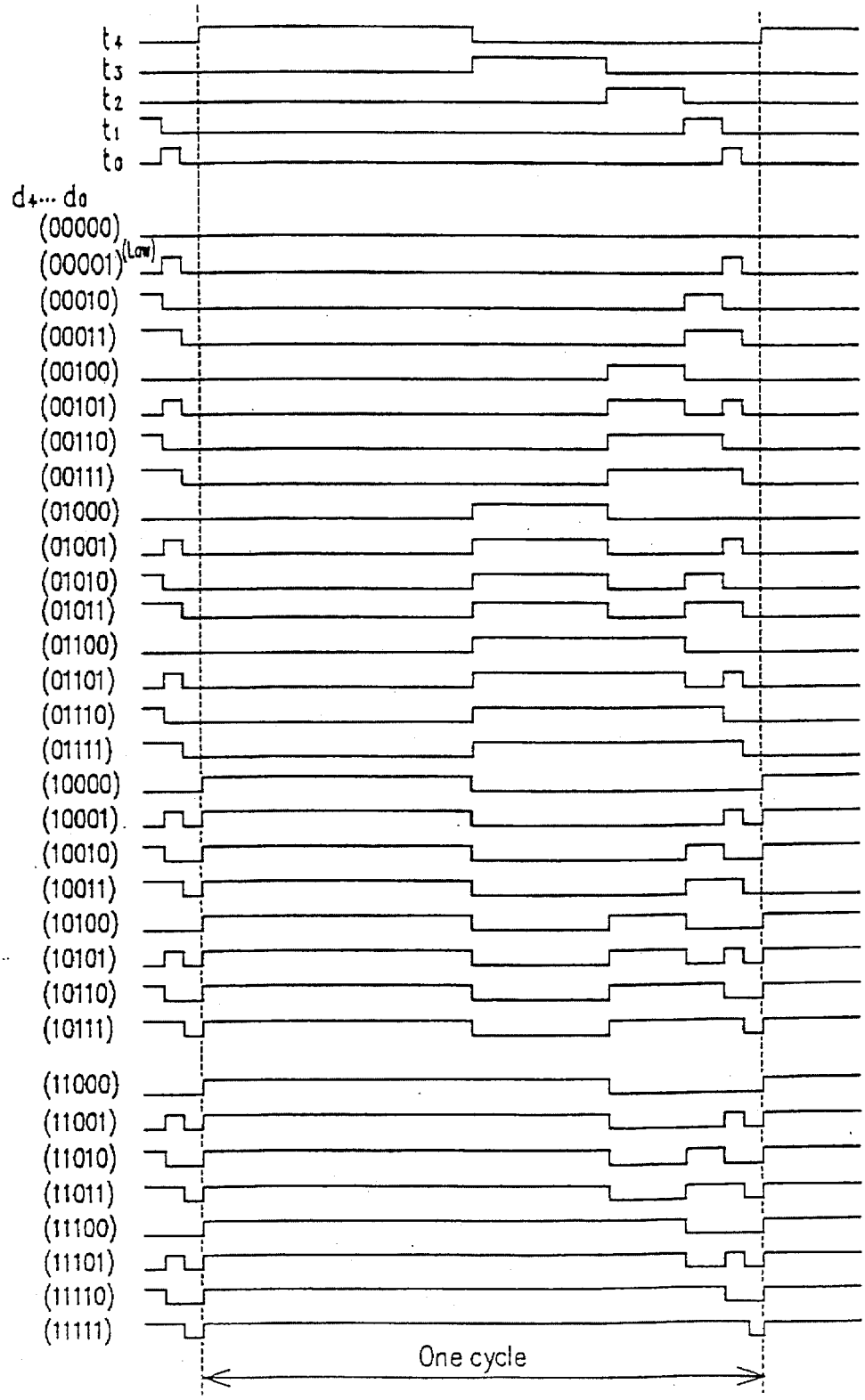
FIG. 14 is a waveform chart of oscillating signals generated by the oscillating signal generation circuit.

FIG. 14 shows waveforms of oscillating signals T Generated by the oscillating signal generation circuit, in accordance with the value represented by the lower five bits $d_0$–$d_4$. As shown in FIG. 14, by combining the oscillating signals $t_0$–$t_4$, oscillating signals with mean values in one cycle which are substantially equal to 0/32, 1/32, 2/32, 3/32, . . . , 28/32, 29/32, 30/32, 31/32. The signal which is kept at the low level in one cycle is regarded as an oscillating signal having a mean value of 0/32 in one cycle.

The configuration of the oscillating signal generation circuit is not limited to that shown in FIG. 12. The oscillating signal generation circuit can have a desirably selected circuit configuration, so far as the oscillating signal generation circuit is a logical circuit satisfying the following logical equation (17).

$$T=d_0t_0+d_1t_1+d_2t_2+d_3t_3+d_4t_4 \quad (17)$$

Table 4 is a logical table showing the relationship among the upper three bits $d_7$, $d_6$, $d_5$ of the 8-bit video data, and the control signals $S_0$, $S_{32}$, $S_{64}$, $S_{96}$, $S_{128}$, $S_{160}$, $S_{192}$, $S_{224}$ and $S_{256}$ output from the selection control circuit SCOL. In Table 4, a variable T denotes a signal T defined by equation (17). A variable T-bar is an inverted signal T-bar obtained by inverting the signal T.

TABLE 4

| $d_7$ | $d_6$ | $d_5$ | $S_0$ | $S_{32}$ | $S_{64}$ | $S_{96}$ | $S_{128}$ | $S_{160}$ | $S_{192}$ | $S_{224}$ | $S_{256}$ |
|---|---|---|---|---|---|---|---|---|---|---|---|
| 0 | 0 | 0 | $\bar{T}$ | T | | | | | | | |
| 0 | 0 | 1 | | $\bar{T}$ | T | | | | | | |
| 0 | 1 | 0 | | | $\bar{T}$ | T | | | | | |
| 0 | 1 | 1 | | | | $\bar{T}$ | T | | | | |
| 1 | 0 | 0 | | | | | $\bar{T}$ | T | | | |
| 1 | 0 | 1 | | | | | | $\bar{T}$ | T | | |
| 1 | 1 | 0 | | | | | | | $\bar{T}$ | T | |
| 1 | 1 | 1 | | | | | | | | $\bar{T}$ | T |

In this way, the operation of the selection control circuit SCOL can be expressed in one simplified logical table, as compared with the conventional case.

From the logical table of Table 4, the following logical equations are obtained.

$$S_0=[0]\text{“}T\text{”} \quad (18)$$

$$S_{32}=[0]T+[32]\text{“}T\text{”} \quad (19)$$

$$S_{64}=[32]T+[64]\text{“}T\text{”} \quad (20)$$

$$S_{96}=[64]T+[96]\text{“}T\text{”} \quad (21)$$

$$S_{128}=[96]T+[128]\text{“}T\text{”} \quad (22)$$

$$S_{160}=[128]T+[160]\text{“}T\text{”} \quad (23)$$

$$S_{192}=[160]T+[192]\text{“}T\text{”} \quad (24)$$

$$S_{224}=[192]T+[224]\text{“}T\text{”} \quad (25)$$

$$S_{256}=[224]T \quad (26)$$

In the above equations, [i] is either a value of logic-0 or logic-1, and j is a value of binary data ($d_7$, $d_6$, $d_5$) which is represented in a decimal notation. When i=(32×j), [i]=logic-1, and otherwise [i]=logic-0. For example, [32]= "$d_7$"·"$d_6$"·$d_5$. In addition, "T" denotes an inverted signal of the signal T.

In accordance with the respective logical equations (18) through (26) which are described above, logical circuits 150 and 160 shown in FIGS. 15 through 16 are obtained. The selection control circuit SCOL is constructed, for example, by the logical circuits 120, 150, and 160 shown in FIGS. 12, 15, and 16.

Figure 15:
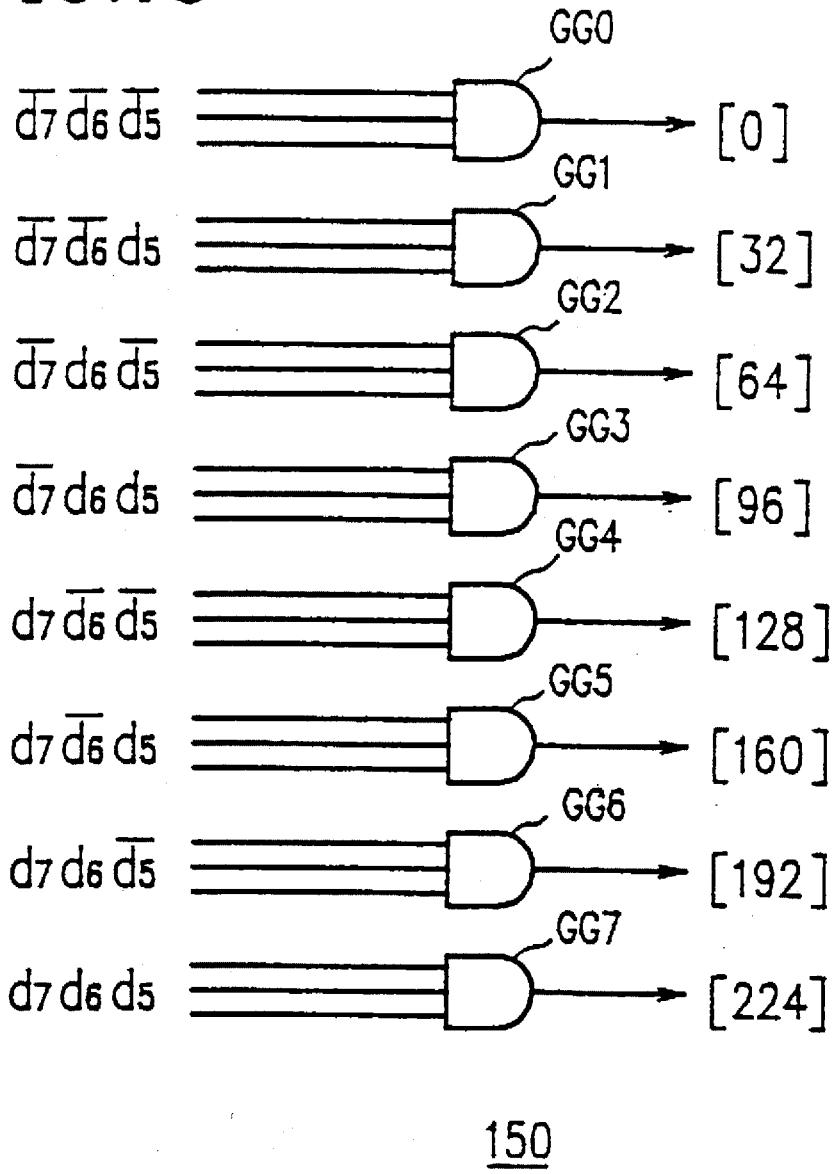
FIG. 15 is a diagram showing a part of a configuration of a selection control circuit SCOL in the driving circuit in Example 2 according to an embodiment of the invention.

The logical circuit 150 shown in FIG. 15 selectively outputs gray-scale voltage specifying signals [0], [32], [64], [96], [128], [160], [192], and [224] for specifying a pair of gray-scale voltages from among a plurality of gray-scale voltages, in accordance with the upper three bits $d_7$, $d_6$, and $d_5$ of the video data.

Figure 16:
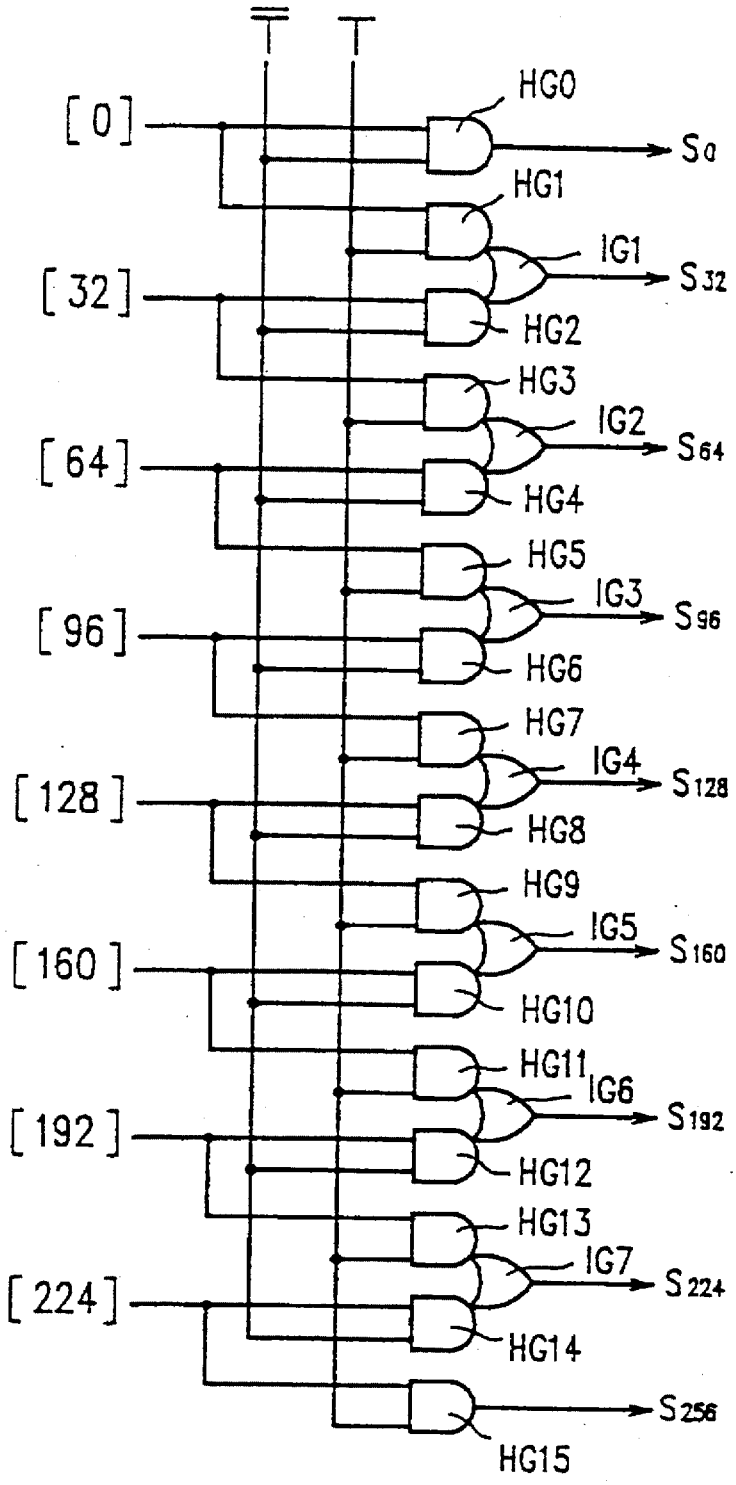
FIG. 16 is a diagram showing another part of the configuration of the selection control circuit SCOL in the driving circuit in Example 2 according to an embodiment of the invention.

The logical circuit 160 shown in FIG. 16 selectively outputs the control signals $S_0$–$S_{255}$, in accordance with the gray-scale voltage specifying signals [0], [32], [64], [96], [128], [160], [192], and [224], the oscillating signal T, and the inverted oscillating signal T-bar. More specifically, the gray-scale voltage specifying signals [0], [32], [64], [96], [128], [160], [192], and [224], and the oscillating signal T are input into AND circuits $HG_1$, $HG_3$, $HG_5$, $HG_7$, $HG_9$, $HG_{11}$, $HG_{13}$, and $HG_{15}$, respectively. The gray-scale voltage specifying signals [0], [32], [64], [96], [128], [160], [192], and [224]and the inverted oscillating signal T-bar are input into AND circuits $HG_0$, $HG_2$, $HG_4$, $HG_6$, $HG_8$, $HG_{10}$, $HG_{12}$, and $HG_{14}$, respectively. The outputs of the AND circuits $HG_1$ and $HG_2$ are coupled to the inputs of an OR circuit $IG_1$, respectively. The outputs of the AND circuits $HG_3$ and $HG_4$ are coupled to the inputs of an OR circuit $IG_2$, respectively. The outputs of the AND circuits $HG_5$ and $HG_6$ are coupled to an OR circuit $IG_3$, respectively. The outputs of the AND circuits $HG_7$ and $HG_8$ are coupled to the inputs of an OR circuit $IG_4$, respectively. The outputs of the AND circuits $HG_9$ and $HG_{10}$ are coupled to the inputs of an OR circuit $IG_5$, respectively. The outputs of the AND circuits $HG_{11}$ and $HG_{12}$ are coupled to the inputs of an OR circuit $IG_6$, respectively. The outputs of the AND circuits $HG_{13}$ and $HG_{14}$ are coupled to the inputs of an OR circuit $IG_7$, respectively. As the outputs of the AND circuit $HG_0$, the OR circuits $IG_1$–$IG_7$, and the AND circuit $HG_{15}$, the control signals $S_0$, $S_{32}$, $S_{64}$, $S_{96}$, $S_{128}$, $S_{160}$, $S_{192}$, $S_{224}$, and $S_{256}$ are obtained.

The control signals $S_0$, $S_{32}$, $S_{64}$, $S_{96}$, $S_{128}$, $S_{160}$, $S_{192}$, $S_{224}$, and $S_{256}$ are supplied to the corresponding analog switches $ASW_0$–$ASW_8$. Each of the control signals $S_0$, $S_{32}$, $S_{64}$, $S_{96}$, $S_{128}$, $S_{160}$, $S_{192}$, $S_{224}$, and $S_{256}$ has either a high-level value or a low-level value. For example, if the control signal is at a high level, the corresponding analog switch is controlled to be in the ON-state. If the control signal is at a low level, the corresponding analog switch is controlled to be in the OFF-state. Alternatively, the relationship between the level of the control signal and the ON/OFF state of the analog signal can be set in a reverse manner. For the practical LSI, the sizes of the logical circuits 120, 150, and 160 can be optimized using design rules for logical circuits.

As described above, in cases where the video data consists of a plurality of bits, oscillating signals having specific waveforms are generated in accordance with video data consisting of at least one bit selected from the plurality of bits, and a pair of gray-scale voltages are specified from a plurality of gray-scale voltages in accordance with video data consisting of bits other than the above-selected bit(s). Thus, a voltage signal of an appropriate level can be output for every value of video data. The oscillating voltage is used for realizing a plurality of interpolated gray-scale voltages between the specified pair of gray-scale voltages which ere specified from among the plurality of gray-scale voltages.

By implementing the logical table of Table 4 into logical circuits, it is possible to realize an 8-bit data driver which outputs 31 oscillating voltages which periodically oscillates between the gray-scale voltage $V_{32n}$ and the gray-scale voltage $V_{32(n+1)}$. In the case where such an oscillating voltage is applied to the data line of the display apparatus, the AC component of the oscillating voltage is suppressed due to the characteristics of a low-pass filter based on a resistance component and a capacitance component existing between the data line and the pixel. As a result, a voltage which is substantially equal to a mean value of the oscillating voltage is applied to the pixel. Thus, voltages shown in Table 5 are applied, where n=1, 2, 3, 4, 5, 6, and 7. The method for applying the mean voltage to a pixel by utilizing the characteristics of the low-pass filter is described in detail in Japanese Laid-Open Patent Publication No. 6-27900.

TABLE 5

| Lower five bits (decimal number) | Voltage |
|---|---|
| 0 | $V_{32n}$ |
| 1 | $\frac{31V_{32n}+V_{32(n+1)}}{32}$ |

TABLE 5-continued

| Lower five bits (decimal number) | Voltage |
|---|---|
| 2 | $\frac{30V_{32n}+2V_{32(n+1)}}{32}$ |
| 3 | $\frac{29V_{32n}+3V_{32(n+1)}}{32}$ |
| 4 | $\frac{28V_{32n}+4V_{32(n+1)}}{32}$ |
| 5 | $\frac{27V_{32n}+5V_{32(n+1)}}{32}$ |
| 6 | $\frac{26V_{32n}+6V_{32(n+1)}}{32}$ |
| 7 | $\frac{25V_{32n}+7V_{32(n+1)}}{32}$ |
| 8 | $\frac{24V_{32n}+8V_{32(n+1)}}{32}$ |
| 9 | $\frac{23V_{32n}+9V_{32(n+1)}}{32}$ |
| 10 | $\frac{22V_{32n}+10V_{32(n+1)}}{32}$ |
| 11 | $\frac{21V_{32n}+11V_{32(n+1)}}{32}$ |
| 12 | $\frac{20V_{32n}+12V_{32(n+1)}}{32}$ |
| 13 | $\frac{19V_{32n}+13V_{32(n+1)}}{32}$ |
| 14 | $\frac{18V_{32n}+14V_{32(n+1)}}{32}$ |
| 15 | $\frac{17V_{32n}+15V_{32(n+1)}}{32}$ |
| 16 | $\frac{16V_{32n}+16V_{32(n+1)}}{32}$ |
| 17 | $\frac{15V_{32n}+17V_{32(n+1)}}{32}$ |
| 18 | $\frac{14V_{32n}+18V_{32(n+1)}}{32}$ |
| 19 | $\frac{13V_{32n}+19V_{32(n+1)}}{32}$ |
| 20 | $\frac{12V_{32n}+20V_{32(n+1)}}{32}$ |
| 21 | $\frac{11V_{32n}+21V_{32(n+1)}}{32}$ |
| 22 | $\frac{10V_{32n}+22V_{32(n+1)}}{32}$ |
| 23 | $\frac{9V_{32n}+23V_{32(n+1)}}{32}$ |
| 24 | $\frac{8V_{32n}+24V_{32(n+1)}}{32}$ |
| 25 | $\frac{7V_{32n}+25V_{32(n+1)}}{32}$ |
| 26 | $\frac{6V_{32n}+26V_{32(n+1)}}{32}$ |

TABLE 5-continued

| Lower five bits (decimal number) | Voltage |
|---|---|
| 27 | $\frac{5V_{32n}+27V_{32(n+1)}}{32}$ |
| 28 | $\frac{4V_{32n}+28V_{32(n+1)}}{32}$ |
| 29 | $\frac{3V_{32n}+29V_{32(n+1)}}{32}$ |
| 30 | $\frac{2V_{32n}+30V_{32(n+1)}}{32}$ |
| 31 | $\frac{V_{32n}+31V_{32(n+1)}}{32}$ |

Where in n = 0, 1, 2, 3, . . . 7

As described above, according to the driving circuit of this example, it is possible to generate 31 kinds of intermediate voltages between the paired gray-scale voltages. Accordingly, 9 kinds of gray-scale voltages result in a display of an image with 256 gray scales. In addition, according to the driving circuit of this example, a large number of oscillating signals can be generated based on a smaller number of oscillating signals, so that it is possible to reduce the number of lines for supplying the oscillating signals to the selection control circuit. As a result, the driving circuit of this example has a simplified configuration, as compared with the conventional driving circuit or the driving circuit of Example 1.

In this example, the number of the oscillating signals $t_0$–$t_4$ has been assumed to be equal to the number of lower bits (i.e., 5) used for specifying the oscillating signal T of the 8-bit video data. However, the invention is not limited to this specific case. For example, some of the oscillating signals $t_0$–$t_4$ can be omitted, because the omitted oscillating signal (s) can be generated by repeatedly using the remaining oscillating signals. Also, the duty ratio of the oscillating signal is not limited to the above-described example.

EXAMPLE 3

As described above, the driving circuit in Example 2 outputs an oscillating voltage which oscillates between the gray-scale voltage $V_{224}$ and the gray-scale voltage $V_{256}$, in accordance with the video data having the maximum value of 255 which can be represented by 8 bits. As a result, intermediate voltages between the gray-scale voltage $V_{224}$ and the gray-scale voltage $V_{256}$ are applied to the pixel.

Example 3 describes a driving circuit which directly outputs the gray-scale voltage $V_{256}$ in accordance with the video data having the maximum value of 255 which can be represented by 8 bits.

The configuration of the driving circuit in this example is identical with that of the driving circuit shown in FIG. 11 except for the oscillating signal generation circuit. The oscillating signal Generation circuit satisfies the following equation.

$$T=[255]\text{bar}\ (d_0t_0+d_1t_1+d_2t_2+d_3t_3+d_4t_4)+[255], \quad (27)$$

where $[255]=d_7\cdot d_6\cdot d_5\cdot d_4\cdot d_3\cdot d_2\cdot d_1\cdot d_0$.

According to Equation (27), when the value of the video data is 255, the value of the variable T is 1, so that only the value of the control signal $S_{256}$ is 1 on the basis of Table 4. As a result, only the analog switch $ASW_8$ is turned ON, so that only the gray-scale voltage $V_{256}$ is output. Accordingly, it is possible to clearly distinguish the gray scales in the case where the video data has the value of 255 from the gray scales in the case where the video data has the value of 254. Therefore, it is possible to increase the contrast (the maximum gray scale/the minimum gray scale) of the image displayed on the display apparatus.

Figure 17:
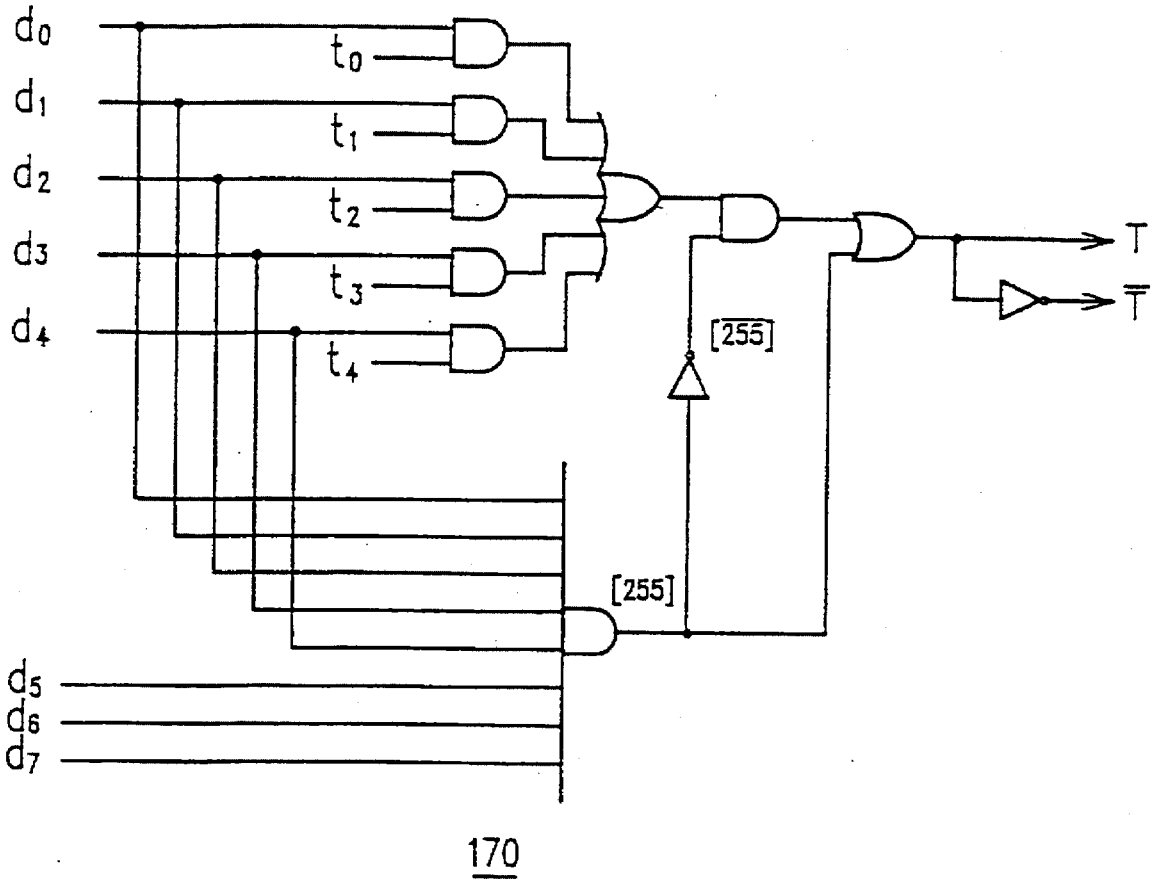
FIG. 17 is a diagram showing the configuration of an oscillating signal generation circuit in a driving circuit in Example 3 according to an embodiment of the invention.

FIG. 17 shows an example in which the oscillating signal generation circuit is implemented as a logical circuit. However, the configuration of the oscillating signal generation circuit is not limited to that shown in FIG. 17. The oscillating signal generation circuit can have any desired configuration, so far as the logical circuit satisfies the logical equation expressed as Equation (27).

According to the driving circuit of this example, it is possible to reduce the number of oscillating signals, as in the driving circuit of Example 2. Therefore, it is possible to reduce the number of lines for supplying the oscillating signals to the selection control circuit. Such effects are remarkably attained in cases where the invention is applied to a driving circuit for a display with multiple gray scales such as an 8-bit data driver for the following reasons.

According to the conventional design concept, the 8-bit data driver necessitates 16 oscillating signals. On the other hand, the 8-bit data driver of Examples 2 and 3 only requires five oscillating signals $t_0$–$t_4$. These oscillating signals are required to be supplied to all of the selection control circuits provided in the data driver, so that the lines for supplying the oscillating signals to the selection control circuits are disposed over the entire LSI to which the data driver is mounted. Accordingly, the reduction of the number of lines for supplying the oscillating signals to the selection control circuits largely contributes to the miniaturization of the LSI chip. In addition, the oscillating signals are signals which are always operating, so that the reduction of the number of oscillating signals may result in the reduction of power consumption.

In cases where the invention is applied to a 6-bit data driver, the required number of oscillating signals is reduced from four to three.

As described above, the data drivers of Examples 2 and 3 have at least two features. The first feature is that a plurality of oscillating signals are generated by a simple logic operation with respect to the original oscillating signals. The plurality of oscillating signals are generated by an oscillating signal generation circuit. The second feature is that the plurality of generated oscillating signals are used as parameters for defining the mean value of the oscillating voltage which oscillates between a pair of gray-scale voltages. Due to these features, the driving circuits of Examples 2 and 3 have an advantage in that the size of logical circuits for all of the selection control circuit can drastically be reduced. The advantage is described below in detail.

Figure 18:
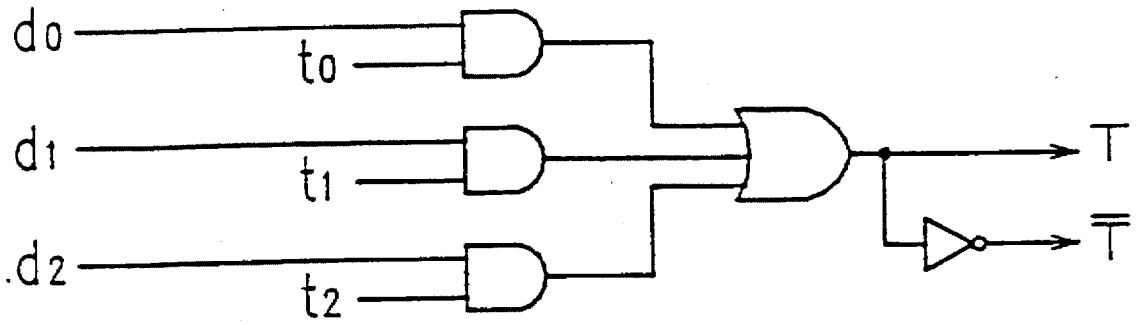
FIG. 18 is a diagram showing the configuration of an oscillating signal generation circuit in a driving circuit for 6 bits according to an embodiment of the invention.
Figure 19:
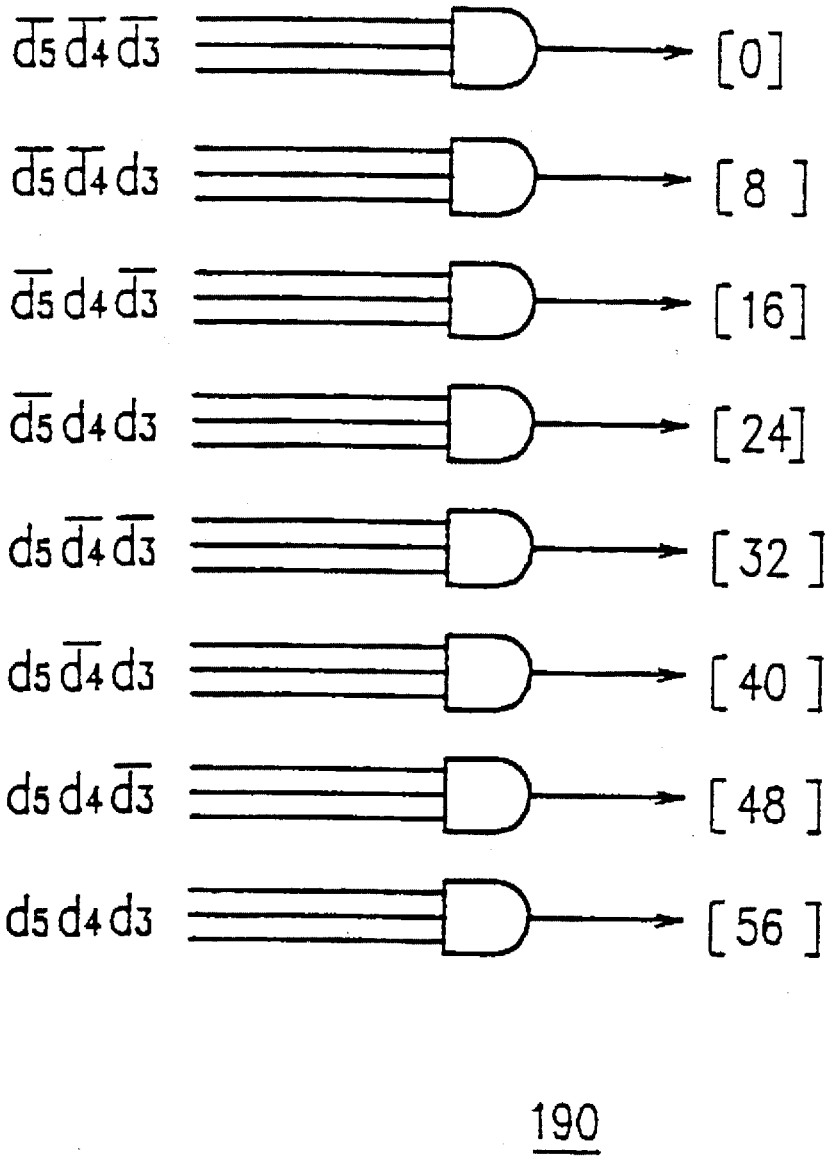
FIG. 19 is a diagram showing a part of a configuration of a selection control circuit SCOL in the driving circuit for 6 bits according to an embodiment of the invention.
Figure 20:
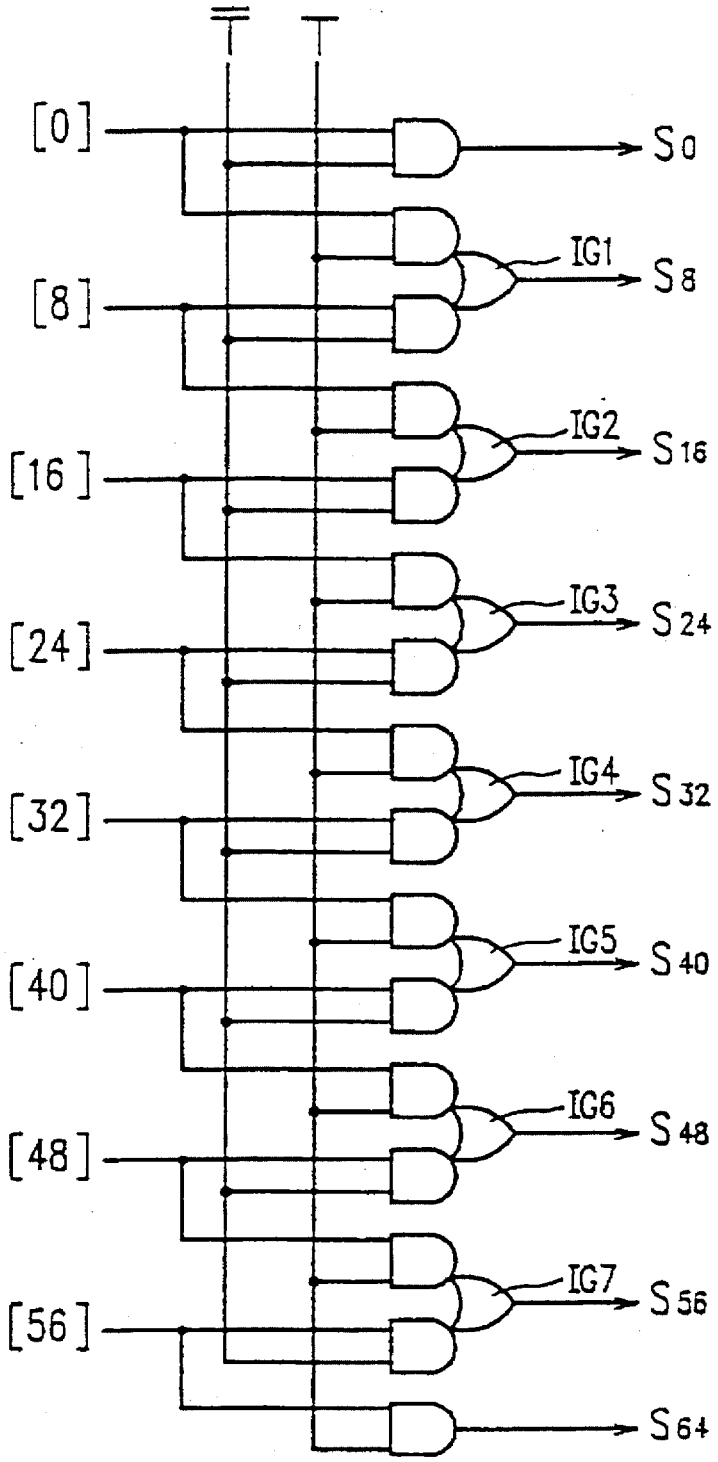
FIG. 20 is a diagram showing another part of the configuration of the selection control circuit SCOL in the driving circuit for 6 bits according to an embodiment of the invention.
Figure 21:
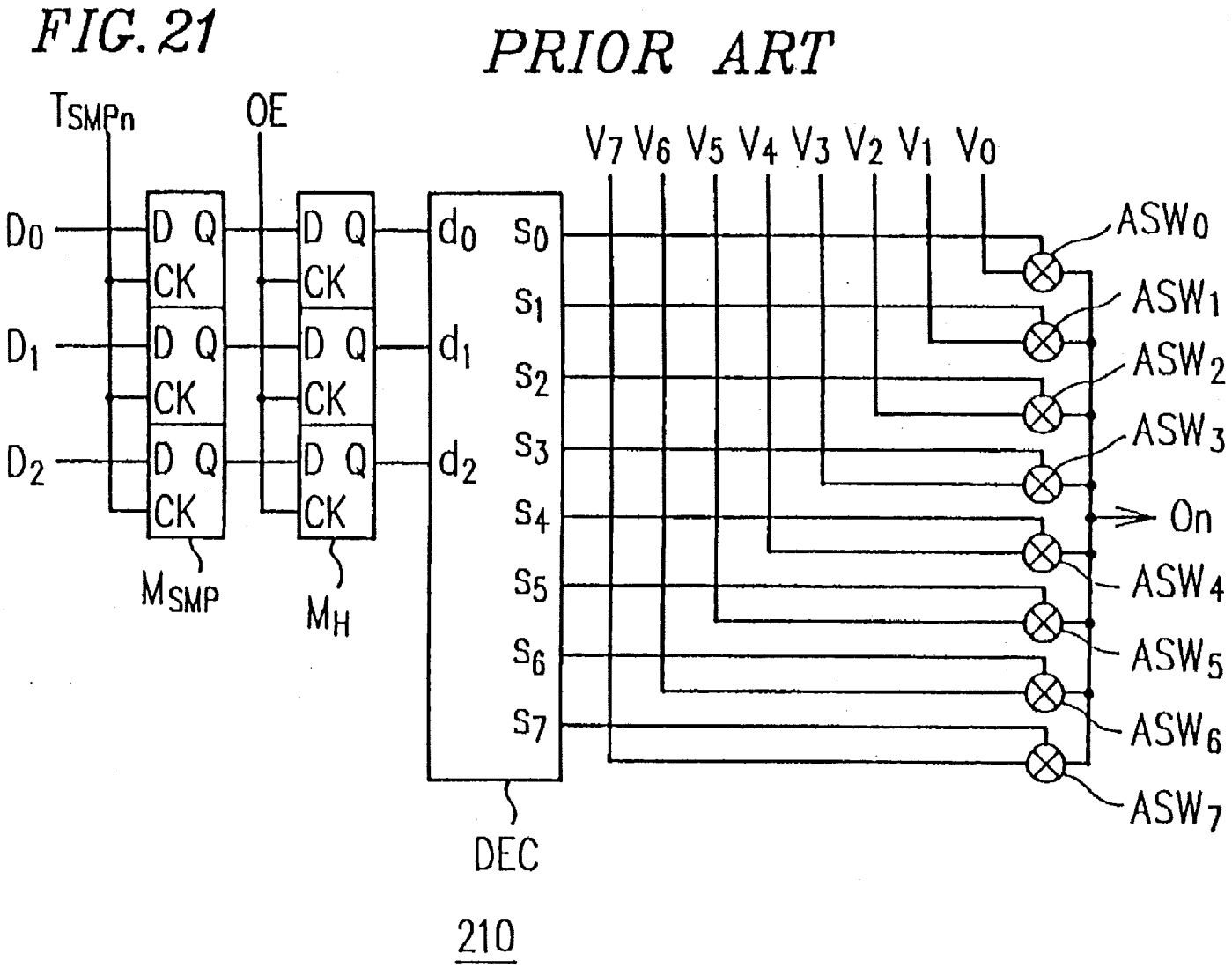
FIG. 21 PRIOR ART
FIG. 21 is a diagram showing a part of a configuration for a data driver in a conventional driving circuit.

FIGS. 18, 19, and 20 show configurations of a selection control circuit in the 6-bit data driver according to the invention. Table 6 shows the logical table for defining the operation of the selection control circuit. When the configuration of the 8-bit data driver shown in FIGS. 12, 15, and 16 is compared with the configuration of the 6-bit data driver shown in FIGS. 18, 19, and 20, it is found that they are identical with each other except for the oscillating signal generation circuit. This is because the logical table (Table 4) of the selection control circuit for 8 bits has the same format as that of the logical table (table 6) of the selection control circuit for 6 bits. From the logical tables, in this example, it is found that the required number of gray-scale voltages in the selection control circuit for 8 bits is equal to the required number of gray-scale voltages in the selection control circuit for 6 bits. In this example, the number of gray-scale voltages is 9.

As described above, according to the invention, the selection control circuit for 8 bits can be realized in the same size as that of the selection control circuit for 6 bits. According to the conventional technique, the selection control circuit for 8 bits had the size which was at least several times as large as that of the selection control circuit for 6 bits. Thus, the size reduction effect for the selection control circuit according to the invention is significantly great, because the data driver has a plurality of outputs and each of the outputs requires a selection control circuit. By reducing the size of the selection control circuit, the cost for the entire data driver can be greatly decreased. For example, as the result of the conventional design concept, it was difficult to provide the 8-bit data driver at a reasonable price. According to the invention, such an 8-bit data driver can be provided at a reasonable price for the first time.

For the above-described reasons, as the invention is applied to a data driver for realizing a larger number of gray-scales, the size reduction effect for the selection control circuit according to the invention becomes greater.

TABLE 6

| $d_5$ | $d_4$ | $d_3$ | $S_0$ | $S_8$ | $S_{16}$ | $S_{24}$ | $S_{32}$ | $S_{40}$ | $S_{48}$ | $S_{56}$ | $S_{64}$ |
|---|---|---|---|---|---|---|---|---|---|---|---|
| 0 | 0 | 0 | $\bar{T}$ | T | | | | | | | |
| 0 | 0 | 1 | | $\bar{T}$ | T | | | | | | |
| 0 | 1 | 0 | | | $\bar{T}$ | T | | | | | |
| 0 | 1 | 1 | | | | $\bar{T}$ | T | | | | |
| 1 | 0 | 0 | | | | | $\bar{T}$ | T | | | |
| 1 | 0 | 1 | | | | | | $\bar{T}$ | T | | |
| 1 | 1 | 0 | | | | | | | $\bar{T}$ | T | |
| 1 | 1 | 1 | | | | | | | | $\bar{T}$ | T |

In addition, when the configuration of the selection control circuit in the 6-bit data driver shown in FIGS. 18, 19, and 20 is compared with the configuration of the selection control circuit in the conventional 6-bit data driver shown in FIGS. 24 and 25, the former circuit is much more compact than the latter circuit.

In the above-described examples, the interpolation is started with the gray scale 0 and performed from the gray scale 1. Alternatively, the interpolation may be performed in a reversed sequence. For example, the interpolation is started with the gray scale 255 and performed from the gray scale 254. In this case, in the driving circuit of Example 3, the variable T is defined so that the gray-scale voltage $V_0$ is directly output when the value of the video data is 0.

According to the invention, it is possible to obtain one or more interpolated voltages from voltages supplied from given voltage sources, whereby the number of voltage sources can be greatly decreased as compared with a conventional driving circuit which requires a large number of voltage sources. If the voltage sources are provided from the outside of the driving circuit, the number of input terminals of the driving circuit can be reduced. If the driving circuit is constructed as an LSI, the number of input terminals of the LSI can be reduced. According to the invention, it is possible to realize a driving LSI for displaying an image with multiple gray scales which could not be realized by the prior art example because of the increase in the number of terminals. In the present invention, the following effects can be attained: (1) the production cost of a display apparatus and a driving circuit are largely reduced; (2) a driving circuit for multiple gray scales which could not be practically produced due to the chip size or the LSI installation can be readily produced; and (3) the power consumption is decreased because a large number of voltage sources are not required.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A driving circuit for driving a display apparatus which includes pixels and data lines for applying voltages to the pixels and which displays an image with multiple gray scales in accordance with video data consisting of a plurality of bits, the driving circuit comprising:

oscillating signal specifying means for receiving a plurality of oscillating signals and for defining a variable T to have a frequency corresponding to one of the plurality of oscillating signals, the received oscillating signals having respective mean values which are different from each other, wherein the variable T is determined in accordance with a value represented by bits selected from the plurality of bits of the video data, and for defining a variable T-bar which is obtained by inverting the variable T;

gray-scale voltage specifying means for producing gray-scale voltage specifying signals which specify a first gray-scale voltage and a second gray-scale voltage among a plurality of gray-scale voltages supplied from gray-scale voltage supply means, in accordance with a value represented by bits other than the selected bits of the plurality of bits of the video data; and output means for outputting one of the first gray-scale voltage and the second gray-scale voltage specified by the gray-scale voltage specifying signals to the data lines, in accordance with the variable T and the variable T-bar.

2. A driving circuit according to claim 1, wherein the first gray-scale voltage and the second gray-scale voltage are adjacent ones of the plurality of gray-scale voltages.

3. A driving circuit according to claim 1, wherein the plurality of oscillating signals have respective duty ratios which are different from each other.

4. A driving circuit according to claim 3, wherein at least one of the plurality of oscillating signals is an inverted signal which is obtained by inverting another one of the plurality of oscillating signals.

5. A driving circuit according to claim 3, wherein the plurality of oscillating signals include oscillating signals having duty ratios of 8:0, 7:1, 6:2, 5:3, 4:4, 3:5, 2:6, and 1:7, respectively.

6. A driving circuit according to claim 1, wherein the video data consists of (x+y) bits, where each of x and y is a positive integer, the gray-scale voltage specifying means produces $(2^x+1)$ kinds of gray-scale voltage specifying signals for specifying $2^X$ pairs of a first gray-scale voltage and a second gray-scale voltage among the plurality of gray-scale voltages, the oscillating signal specifying means defines the variable T as corresponding to one of the received $2^Y$ number of oscillating signals, whereby $(2^y-1)$ intermediate voltages of levels different from each other are generated between the first gray-scale voltage and the second gray-scale voltage specified by the gray-scale voltage specifying means, thereby displaying an image with $2^{(x+y)}$ gray scales.

7. A driving circuit according to claim 1, wherein the oscillating signal specifying means includes:

oscillating signal generating means for defining the variable T by combining the plurality of received oscillating signals; and inversion means for inverting the variable T so as to obtain the variable T-bar, and wherein each of the plurality of received oscillating signals oscillates between a first level value and a second level value, respective time periods during which the received oscillating signals have the first level value in one cycle being different from each other, respective lengths of the periods in which the plurality of original oscillating signals have the first level value in one cycle being weighted in accordance with corresponding bits of the plurality of bits of the video data.

8. A driving circuit according to claim 7, wherein the number of the plurality of received oscillating signals is equal to the number of the selected bits among the plurality of bits of the video data.

9. A driving circuit for driving a display apparatus which includes pixels and data lines for applying voltages to the pixels and which displays an image with multiple gray scales in accordance with video data consisting of a plurality of bits, the driving circuit comprising:

control signal generating means for generating a plurality of control signals in accordance with video data consisting of a plurality of bits; and a plurality of switching means, each of the plurality of switching means being supplied with a corresponding one of the plurality of control signals and a corresponding one of a plurality of gray-scale voltages generated by gray-scale voltage generating means, the gray-scale voltage supplied to the switching means being output to the data lines via the switching means in accordance with the control signal supplied to the switching means, wherein the control signal generating means includes:

oscillating signal specifying means for receiving a plurality of oscillating signals and for defining a variable T to have a frequency corresponding to one of the plurality of oscillating signals, the received oscillating signals having respective duty ratios which are different from each other, wherein the variable T is determined in accordance with a value represented by bits selected from the plurality of bits of the video data, and for defining a variable T-bar which is obtained by inverting the variable T;

gray-scale voltage specifying means for producing gray-scale voltage specifying signals which specify a first gray-scale voltage and a second gray-scale voltage among the plurality of gray-scale voltages, in accordance with a value represented by bits other than the selected bits of the plurality of bits of the video data; and output means for outputting a first control signal which oscillates at a duty ratio determined by the variable T to the switching means which are supplied with the first gray-scale voltage specified by the gray-scale voltage specifying signals and for outputting a second control signal which oscillates at a duty ratio determined by the variable T-bar to the switching means which are supplied with the second gray-scale voltage specified by the gray-scale voltage specifying signals.

10. A driving circuit according to claim 9, wherein the first gray-scale voltage and the second gray-scale voltage are adjacent ones of the plurality of gray-scale voltages.

11. A driving circuit according to claim 9, wherein at least one of the plurality of oscillating signals is an inverted signal which is obtained by inverting another one of the plurality of oscillating signals.

12. A driving circuit according to claim 9, wherein the plurality of oscillating signals include oscillating signals having duty ratios of 8:0, 7:1, 6:2, 5:3, 4:4, 3:5, 2:6, and 1:7, respectively.

13. A driving circuit according to claim 9, wherein the video data consists of (x+y) bits, where each of x and y is a positive integer, the gray-scale voltage specifying means produces $(2^x+1)$ kinds of gray-scale voltage specifying signals for specifying $2^x$ pairs of a first gray-scale voltage and a second gray-scale voltage among the plurality of gray-scale voltages, the oscillating signal specifying means defines the variable T as corresponding to one of $2^y$ number of the received oscillating signals, whereby $(2^y-1)$ intermediate voltages of level different from each other are generated between the first gray-scale voltage and the second gray-scale voltage specified by the gray-scale voltage specifying means, thereby displaying an image with $2^{(x+y)}$ gray scales.

14. A driving circuit according to claim 9, wherein the oscillating signal specifying means includes:

oscillating signal generating means for defining the variable T by combining the plurality of received oscillating signals; and inversion means for inverting the variable T so as to obtain the variable T-bar, and wherein each of the plurality of received oscillating signals oscillates between a first level value and a second level value, respective time periods during which the plurality of received oscillating signals have the first level value in one cycle being different from each other, respective lengths of the periods in which the plurality of original oscillating signals have the first level value in one cycle being weighted in accordance with corresponding bits of the plurality of bits of the video data.

15. A driving circuit according to claim 14, wherein the number of received oscillating signals is equal to the number of selected bits of the plurality of bits of the video data.

16. A driving circuit according to claim 9, wherein the switching means is an analog switch.

* * * * *